US012227340B2

(12) United States Patent
Seiders et al.

(10) Patent No.: US 12,227,340 B2
(45) **Date of Patent: *Feb. 18, 2025**

(54) CONTAINER WITH MAGNETIC CAP

(71) Applicant: YETI Coolers, LLC, Austin, TX (US)

(72) Inventors: Roy Joseph Seiders, Austin, TX (US); John Alan Tolman, Austin, TX (US); Steve Nichols, Austin, TX (US)

(73) Assignee: YETI Coolers, LLC, Austin, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/368,718

(22) Filed: Sep. 15, 2023

(65) Prior Publication Data

US 2024/0002113 A1 Jan. 4, 2024

Related U.S. Application Data

(63) Continuation of application No. 17/677,637, filed on Feb. 22, 2022, now Pat. No. 11,794,960, which is a (Continued)

(51) Int. Cl.

| | |
|---|---|
| ***B65D 47/14*** | (2006.01) |
| ***B65D 1/02*** | (2006.01) |
| ***B65D 25/28*** | (2006.01) |
| ***B65D 25/40*** | (2006.01) |
| ***B65D 41/04*** | (2006.01) |

(Continued)

(52) U.S. Cl.

CPC ..... *B65D 47/14* (2013.01); *B65D 1/0246* (2013.01); *B65D 25/2835* (2013.01); *B65D 25/2864* (2013.01); *B65D 25/40* (2013.01); *B65D 41/04* (2013.01); *B65D 43/0229* (2013.01); *B65D 47/142* (2013.01); *B65D 51/242* (2013.01); *B65D 55/16* (2013.01); *B65D 81/3837* (2013.01); *B65D 81/3841* (2013.01); *B65D 2525/283* (2013.01); *B65D 2543/00351* (2013.01)

(58) Field of Classification Search

CPC ..... B65D 25/2835; B65D 81/3841; B65D 47/142; B65D 47/14

See application file for complete search history.

(56) References Cited

U.S. PATENT DOCUMENTS

| | | | |
|---|---|---|---|
| 459,253 | A | 9/1891 | Metz |
| 1,477,936 | A | 12/1923 | Bott |

(Continued)

FOREIGN PATENT DOCUMENTS

| | | | |
|---|---|---|---|
| AU | 124127 | S | 7/1995 |
| AU | 2005242173 | B2 | 4/2012 |

(Continued)

OTHER PUBLICATIONS

Oct. 18, 2023—(NZ) Examination Report 1—App. No. 752563.

(Continued)

*Primary Examiner* — Jeffrey R Allen

(74) *Attorney, Agent, or Firm* — Banner & Witcoff, Ltd.

(57) ABSTRACT

A container having a canister can be configured to retain a volume of liquid. The canister can be sealed by a lid structure, and the lid structure can have a spout opening. The spout opening may be sealed by a removably-coupled cap. Further, the cap may have a magnetic top surface configured to magnetically couple to a recess on the top surface of the lid for temporary storage of the cap when manually removed from the spout opening.

20 Claims, 11 Drawing Sheets

Related U.S. Application Data continuation of application No. 17/152,503, filed on Jan. 19, 2021, now Pat. No. 11,273,961, which is a continuation of application No. 16/154,178, filed on Oct. 8, 2018, now Pat. No. 10,926,925, which is a continuation of application No. 14/826,612, filed on Aug. 14, 2015, now Pat. No. 10,093,460.

(51) Int. Cl.

| | |
|---|---|
| ***B65D 43/02*** | (2006.01) |
| ***B65D 51/24*** | (2006.01) |
| ***B65D 55/16*** | (2006.01) |
| ***B65D 81/38*** | (2006.01) |

(56) References Cited

U.S. PATENT DOCUMENTS

| | | | |
|---|---|---|---|
| D101,575 | S | 10/1936 | Windbiel |
| D105,256 | S | 7/1937 | Amrine |
| D109,331 | S | 4/1938 | McManus et al. |
| D154,378 | S | 7/1949 | Fuller |
| 2,735,566 | A | 2/1956 | Bramming |
| D177,761 | S | 5/1956 | Reinhardt |
| 2,804,103 | A | 8/1957 | Wall |
| 2,881,776 | A | 4/1959 | Wrage |
| 2,957,596 | A | 10/1960 | Rehborg |
| 2,963,187 | A | 12/1960 | Bramming |
| 3,040,938 | A | 6/1962 | Smith |
| D195,151 | S | 4/1963 | Marsh |
| 3,089,603 | A | 5/1963 | Leslie-Smith |
| 3,124,266 | A | 3/1964 | Morgan |
| 3,140,799 | A | 7/1964 | Mehr |
| 3,141,586 | A | 7/1964 | Wetterek |
| 3,220,695 | A | 11/1965 | Downey et al. |
| 3,239,090 | A | 3/1966 | Bramming |
| 3,249,268 | A | 5/1966 | Neuner |
| 3,285,453 | A | 11/1966 | Wagner |
| 3,307,752 | A | 3/1967 | Anderson |
| 3,439,843 | A | 4/1969 | Corsette |
| 3,456,840 | A | 7/1969 | McAlaster |
| 3,470,929 | A | 10/1969 | Thornton |
| 3,592,349 | A | 7/1971 | Baugh |
| 3,638,821 | A | 2/1972 | Guala |
| D224,646 | S | 8/1972 | Vollquartz |
| 3,752,347 | A | 8/1973 | Bell |
| 3,776,433 | A | 12/1973 | De Treitas |
| 3,785,539 | A | 1/1974 | Wetterek |
| 3,842,790 | A | 10/1974 | Clark |
| 3,863,798 | A | 2/1975 | Kurihara et al. |
| 3,874,541 | A | 4/1975 | Lagneaux et al. |
| D235,303 | S | 6/1975 | Boucher |
| D248,373 | S | 7/1978 | Allen |
| 4,105,148 | A | 8/1978 | Williams |
| 4,190,173 | A | 2/1980 | Mason et al. |
| D256,651 | S | 9/1980 | Leung et al. |
| 4,241,855 | A | 12/1980 | Yoshioka |
| D262,856 | S | 2/1982 | MacTavish et al. |
| 4,358,024 | A | 11/1982 | Underwood |
| 4,452,381 | A | 6/1984 | Freeman |
| 4,497,422 | A | 2/1985 | Klees |
| D279,346 | S | 6/1985 | Ruxton |
| 4,537,044 | A | 8/1985 | Putnam |
| 4,550,862 | A | 11/1985 | Barker et al. |
| D281,567 | S | 12/1985 | Zimmermann |
| D286,604 | S | 11/1986 | Bierlein et al. |
| D286,847 | S | 11/1986 | Zimmermann |
| D287,211 | S | 12/1986 | Weiss |
| 4,625,899 | A | 12/1986 | Stull |
| D289,614 | S | 5/1987 | Sanchez et al. |
| D292,492 | S | 10/1987 | Ross et al. |
| 4,723,677 | A | 2/1988 | Nagel, Jr. |
| D299,010 | S | 12/1988 | Wall |
| 4,932,225 | A | 6/1990 | Bighouse |
| 4,981,233 | A | 1/1991 | Scheurer |
| 5,050,759 | A | 9/1991 | Marble |
| D321,628 | S | 11/1991 | Kobayashi et al. |
| D325,167 | S | 4/1992 | Humfress |
| 5,105,975 | A | 4/1992 | Patterson |
| D329,809 | S | 9/1992 | Bloomfield |
| D332,379 | S | 1/1993 | Murphy |
| 5,181,632 | A | 1/1993 | Latter |
| 5,190,178 | A | 3/1993 | Luch |
| 5,211,299 | A | 5/1993 | Manfredonia |
| 5,232,112 | A | 8/1993 | Howard |
| 5,249,703 | A | 10/1993 | Karp |
| 5,251,788 | A | 10/1993 | Moore |
| D341,319 | S | 11/1993 | Morin |
| 5,366,089 | A | 11/1994 | Parker |
| D354,915 | S | 1/1995 | Schneider et al. |
| 5,392,967 | A | 2/1995 | Satomi et al. |
| D361,265 | S | 8/1995 | Doxey |
| 5,490,622 | A | 2/1996 | Tardif |
| D367,611 | S | 3/1996 | Wagner, III et al. |
| D368,224 | S | 3/1996 | Arndt |
| 5,498,333 | A | 3/1996 | Canther |
| D370,629 | S | 6/1996 | Lynch |
| 5,605,241 | A | 2/1997 | Imperioli |
| 5,605,254 | A | 2/1997 | Wagner, III et al. |
| 5,647,389 | A | 7/1997 | Holloway |
| D384,280 | S | 9/1997 | Kuczer |
| 5,667,106 | A | 9/1997 | Robbins, III |
| D394,184 | S | 5/1998 | Demore |
| D398,193 | S | 9/1998 | Sanchez |
| 5,813,557 | A | 9/1998 | Oratz |
| 5,839,611 | A | 11/1998 | Obadia et al. |
| D402,510 | S | 12/1998 | Miller |
| D405,642 | S | 2/1999 | Toriba |
| D405,650 | S | 2/1999 | Meier |
| D407,211 | S | 3/1999 | Diviak, Sr. |
| D407,273 | S | 3/1999 | Moran |
| D410,175 | S | 5/1999 | Moran |
| 5,906,288 | A | 5/1999 | Dwinell |
| 5,909,820 | A | 6/1999 | Yeh |
| 5,947,319 | A | 9/1999 | Sinski |
| D415,395 | S | 10/1999 | Hunt et al. |
| D415,936 | S | 11/1999 | Moran |
| 6,029,858 | A | 2/2000 | Srokose et al. |
| D422,916 | S | 4/2000 | Herrmann |
| D423,300 | S | 4/2000 | Matsuyama et al. |
| D427,021 | S | 6/2000 | Moran |
| 6,079,589 | A | 6/2000 | Matsuyama et al. |
| 6,102,227 | A | 8/2000 | Cochrane |
| 6,102,244 | A | 8/2000 | Kuwano et al. |
| 6,170,720 | B1 | 1/2001 | Gnepper et al. |
| D437,528 | S | 2/2001 | Kitamura et al. |
| 6,264,072 | B1 | 7/2001 | Johannes |
| D447,410 | S | 9/2001 | Malmborg |
| 6,321,924 | B1 | 11/2001 | Yurkewicz et al. |
| 6,332,557 | B1 | 12/2001 | Moran |
| 6,357,628 | B1 | 3/2002 | Long, Jr. |
| D456,669 | S | 5/2002 | Munari |
| D458,133 | S | 6/2002 | Berish et al. |
| D458,134 | S | 6/2002 | Berish et al. |
| 6,398,052 | B1 | 6/2002 | Cheng et al. |
| 6,471,101 | B1 | 10/2002 | Vardanyan |
| D466,814 | S | 12/2002 | Hurlburt |
| D467,174 | S | 12/2002 | Mozes |
| 6,530,496 | B2 | 3/2003 | Moran |
| 6,536,618 | B1 | 3/2003 | Hwang et al. |
| D474,068 | S | 5/2003 | Fujii et al. |
| D475,924 | S | 6/2003 | Haffner |
| D476,532 | S | 7/2003 | Edwards |
| D476,890 | S | 7/2003 | Hirose |
| 6,601,740 | B1 | 8/2003 | Clive |
| D479,800 | S | 9/2003 | McRae |
| D479,802 | S | 9/2003 | Arduini |
| D479,995 | S | 9/2003 | Duceppe |
| D482,607 | S | 11/2003 | McRae |
| 6,648,158 | B1 | 11/2003 | Lawrence |
| 6,651,838 | B2 | 11/2003 | Bissell |
| 6,651,845 | B1 | 11/2003 | Schroeder |
| D484,355 | S | 12/2003 | De Gooijer |
| 6,662,978 | B2 | 12/2003 | Lin et al. |
| 6,675,998 | B2 | 1/2004 | Forsman et al. |

(56) References Cited

U.S. PATENT DOCUMENTS 6,702,138 B1 3/2004 Bielecki et al.
D490,275 S 5/2004 Moran
6,732,882 B2 5/2004 Belcastro
6,745,923 B2 6/2004 Julian
6,758,364 B1 7/2004 Rohrig
D494,064 S 8/2004 Hook
D494,425 S 8/2004 Segura
6,783,020 B2 8/2004 Featherston et al.
6,908,015 B2 6/2005 Choi et al.
D507,495 S 7/2005 Williams et al.
6,926,179 B2 8/2005 Wagner, III et al.
D511,457 S 11/2005 Biesecker et al.
6,994,233 B2 2/2006 Dygert et al.
D521,314 S 5/2006 Ball
D524,909 S 7/2006 Bakke et al.
D525,518 S 7/2006 Baldwin
D527,219 S 8/2006 Trombly
7,086,548 B2 8/2006 Bartlett
D527,576 S 9/2006 Gluck
D530,141 S 10/2006 Wilgus et al.
D533,032 S 12/2006 Liu et al.
D533,396 S 12/2006 Lipson
D534,762 S 1/2007 Gluck
D536,929 S 2/2007 Kingsley
D536,974 S 2/2007 Smith et al.
7,172,101 B2 2/2007 Find
D537,714 S 3/2007 Yerby et al.
D540,625 S 4/2007 Sandberg
D547,605 S 7/2007 Edelstein et al.
D548,006 S 8/2007 Lapsker
D548,082 S 8/2007 Kingsley
D549,444 S 8/2007 Schnackenberg
7,270,244 B1 9/2007 Liu
D553,914 S 10/2007 Wahl
D554,000 S 10/2007 Walsh
7,275,665 B2 10/2007 Young
7,300,580 B2 11/2007 Lindsey et al.
D557,994 S 12/2007 Wahl
D562,132 S 2/2008 LaMasney
D564,363 S 3/2008 Rhea
D567,007 S 4/2008 Bodum
D567,021 S 4/2008 Bach et al.
D569,195 S 5/2008 Kim
D572,585 S 7/2008 Perrin et al.
D574,237 S 8/2008 Yates, III
D581,211 S 11/2008 Lapsker
D582,206 S 12/2008 Fuller
D583,200 S 12/2008 Moran
7,458,486 B2 12/2008 Weist et al.
D584,566 S 1/2009 Fuller
D584,623 S 1/2009 Chupak
D586,183 S 2/2009 Junkel
D587,533 S 3/2009 Carreno
D589,348 S 3/2009 Miller et al.
7,533,783 B2 5/2009 Choi et al.
D594,346 S 6/2009 Mouquet
7,556,172 B2 7/2009 Lane
D599,616 S 9/2009 Cresswell et al.
D601,436 S 10/2009 Stephens et al.
D603,331 S 11/2009 Schupp
D603,722 S 11/2009 Reimer
D604,181 S 11/2009 Reimer
D604,561 S 11/2009 Chisholm
7,622,039 B2 11/2009 Farrell et al.
D605,040 S 12/2009 Fry et al.
D605,060 S 12/2009 Reimer
D605,942 S 12/2009 Miksovsky
D610,871 S 3/2010 Alviar et al.
D611,346 S 3/2010 Camomile
D612,197 S 3/2010 Chan
D612,235 S 3/2010 Cresswell et al.
D612,660 S 3/2010 Bodum
D614,918 S 5/2010 Chisholm
D614,955 S 5/2010 Cresswell et al.
D615,360 S 5/2010 Joy et al.
D615,361 S 5/2010 Goble
D615,816 S 5/2010 Joy et al.
D615,860 S 5/2010 Cero, Jr.
D616,703 S 6/2010 Joy et al.
D616,743 S 6/2010 Cresswell et al.
D616,744 S 6/2010 Cresswell et al.
D619,457 S 7/2010 Walsh
D619,458 S 7/2010 Walsh
D619,459 S 7/2010 Walsh
D620,798 S 8/2010 Cresswell et al.
D621,207 S 8/2010 Bodum
D621,257 S 8/2010 Gullickson et al.
D621,258 S 8/2010 Gullickson et al.
D621,648 S 8/2010 Lown et al.
D622,089 S 8/2010 Daniel et al.
D622,145 S 8/2010 Walsh
D623,475 S 9/2010 Aarnoudse et al.
D623,480 S 9/2010 Moran
D623,481 S 9/2010 Moran
D623,943 S 9/2010 Weld
D625,560 S 10/2010 Olson et al.
D626,414 S 11/2010 Cresswell et al.
D626,416 S 11/2010 Cresswell et al.
D627,601 S 11/2010 Eyal
D627,602 S 11/2010 Eyal
D627,604 S 11/2010 Eyal
D628,018 S 11/2010 Gilbert
D628,486 S 12/2010 Lane
D628,898 S 12/2010 Barnett et al.
D628,900 S 12/2010 Barnett et al.
D628,901 S 12/2010 Barnett et al.
D629,689 S 12/2010 Cresswell et al.
D629,690 S 12/2010 Cresswell et al.
D629,691 S 12/2010 Cresswell et al.
7,845,524 B2 12/2010 Evans et al.
D630,474 S 1/2011 Gilbert
D630,475 S 1/2011 Lu
D631,349 S 1/2011 Amell et al.
7,870,968 B2 1/2011 Hanson
D631,666 S 2/2011 Lim et al.
D633,338 S 3/2011 Rosbach et al.
D633,794 S 3/2011 Cresswell et al.
D633,795 S 3/2011 Cresswell et al.
D633,796 S 3/2011 Cresswell et al.
D633,797 S 3/2011 Cresswell et al.
D634,156 S 3/2011 Fuller et al.
D634,160 S 3/2011 Cetera
D634,192 S 3/2011 Mueller
D635,457 S 4/2011 Lane
D635,856 S 4/2011 Lauret
D638,695 S 5/2011 Woodrow et al.
D638,708 S 5/2011 Walsh
D639,164 S 6/2011 Walsh
D639,177 S 6/2011 Pape
D639,661 S 6/2011 Llerena
D639,663 S 6/2011 Llerena
D640,466 S 6/2011 Staton
7,959,044 B1 6/2011 Christian et al.
D641,257 S 7/2011 Thiebaut et al.
D641,591 S 7/2011 Tsukida
D643,691 S 8/2011 Selina et al.
D643,693 S 8/2011 Jama
D645,709 S 9/2011 Endo
8,011,535 B2 9/2011 Tauber et al.
D648,984 S 11/2011 Gullickson et al.
D651,050 S 12/2011 Goshi
D651,847 S 1/2012 Gilbert
D652,255 S 1/2012 Carland
D652,682 S 1/2012 Eyal
D653,499 S 2/2012 Dietterle et al.
D654,762 S 2/2012 Gilbert
8,113,239 B2 2/2012 Richards et al.
D655,134 S 3/2012 Gilbert
D655,581 S 3/2012 Kotani
D657,196 S 4/2012 Beyers, III
D658,008 S 4/2012 Wahl et al.
D658,064 S 4/2012 Barnes et al.
D658,431 S 5/2012 Gilbert
D658,445 S 5/2012 Carreno

(56) References Cited

U.S. PATENT DOCUMENTS

| | | | |
|---|---|---|---|
| D659,007 | S | 5/2012 | Pape |
| D660,084 | S | 5/2012 | Gilbert |
| 8,177,097 | B2 | 5/2012 | Duran |
| D662,360 | S | 6/2012 | George |
| 8,210,572 | B2 | 7/2012 | Davis |
| 8,215,511 | B1 | 7/2012 | Lin |
| D664,809 | S | 8/2012 | Eyal |
| D665,621 | S | 8/2012 | Eyal |
| 8,245,600 | B2 | 8/2012 | Beard |
| 8,245,870 | B2 | 8/2012 | McKinney et al. |
| 8,251,247 | B1 | 8/2012 | Breckner |
| D666,908 | S | 9/2012 | Dabah et al. |
| 8,256,631 | B2 | 9/2012 | Hoffmann et al. |
| 8,272,532 | B2 | 9/2012 | Michaelian et al. |
| D668,913 | S | 10/2012 | Mayer |
| 8,292,133 | B2 | 10/2012 | Baughman et al. |
| D670,137 | S | 11/2012 | Gilbert |
| D671,372 | S | 11/2012 | Zou |
| D672,238 | S | 12/2012 | Aziz et al. |
| D672,609 | S | 12/2012 | Aziz et al. |
| 8,336,732 | B1 | 12/2012 | Tobias |
| D673,459 | S | 1/2013 | Moran, Sr. |
| D675,100 | S | 1/2013 | Herbst |
| D675,865 | S | 2/2013 | Wahl |
| D676,706 | S | 2/2013 | Kern et al. |
| D676,764 | S | 2/2013 | Moore et al. |
| D677,103 | S | 3/2013 | Melzer |
| D677,119 | S | 3/2013 | Ying |
| D678,729 | S | 3/2013 | Peeters et al. |
| D678,772 | S | 3/2013 | Johnson et al. |
| D679,185 | S | 4/2013 | Brown et al. |
| D680,389 | S | 4/2013 | Zemel et al. |
| D682,016 | S | 5/2013 | Knight |
| D682,617 | S | 5/2013 | Miksovsky et al. |
| 8,443,993 | B1 | 5/2013 | Desselle |
| 8,443,994 | B1 | 5/2013 | Desselle |
| D684,059 | S | 6/2013 | Johnson et al. |
| 8,459,468 | B2 | 6/2013 | Lin |
| 8,459,502 | B2 | 6/2013 | Swanick |
| D686,074 | S | 7/2013 | Brinckerhoff et al. |
| D686,078 | S | 7/2013 | Johnson et al. |
| 8,474,648 | B1 | 7/2013 | Ritzen |
| D688,093 | S | 8/2013 | Roth et al. |
| 8,505,760 | B2 | 8/2013 | Ott |
| 8,505,787 | B2 | 8/2013 | Fox et al. |
| 8,523,024 | B2 | 9/2013 | Piscopo et al. |
| D690,987 | S | 10/2013 | Gallen |
| D690,988 | S | 10/2013 | Audette |
| D691,848 | S | 10/2013 | Trudeau et al. |
| 8,550,269 | B2 | 10/2013 | Lane |
| D693,628 | S | 11/2013 | Tavenner et al. |
| D693,698 | S | 11/2013 | Miller, Jr. |
| 8,584,902 | B2 | 11/2013 | Dejonge |
| D695,138 | S | 12/2013 | Ball |
| 8,613,369 | B2 | 12/2013 | Kitto |
| D696,945 | S | 1/2014 | Newman |
| D697,404 | S | 1/2014 | Johnson et al. |
| D697,802 | S | 1/2014 | Lane |
| 8,622,229 | B2 | 1/2014 | Lane |
| D698,668 | S | 2/2014 | Vaughn |
| 8,657,148 | B2 | 2/2014 | Krammes et al. |
| D701,464 | S | 3/2014 | Ogata et al. |
| D702,092 | S | 4/2014 | Mettler et al. |
| D702,506 | S | 4/2014 | Mettler et al. |
| 8,695,822 | B2 | 4/2014 | Kwon |
| 8,701,881 | B2 | 4/2014 | Gibson et al. |
| 8,701,924 | B2 | 4/2014 | Dalbec |
| 8,708,176 | B2 | 4/2014 | Andis |
| D703,998 | S | 5/2014 | Funnell, II et al. |
| D704,053 | S | 5/2014 | Kim |
| 8,720,730 | B2 | 5/2014 | Bodden, Jr. |
| 8,746,498 | B2 | 6/2014 | Maldonado et al. |
| 8,752,720 | B1 | 6/2014 | Habig et al. |
| D708,484 | S | 7/2014 | Bishop |
| D708,914 | S | 7/2014 | Moran, Sr. |
| D708,954 | S | 7/2014 | Barnes et al. |
| D709,734 | S | 7/2014 | Kotani |
| 8,777,031 | B2 | 7/2014 | Aneas |
| D710,698 | S | 8/2014 | Giraud et al. |
| D712,254 | S | 9/2014 | Geis et al. |
| D712,255 | S | 9/2014 | Geis et al. |
| D713,268 | S | 9/2014 | Jones et al. |
| D713,365 | S | 9/2014 | Green |
| 8,833,586 | B2 | 9/2014 | Meyers et al. |
| D714,584 | S | 10/2014 | Boroski |
| D717,102 | S | 11/2014 | Taketani et al. |
| D717,601 | S | 11/2014 | Dixon |
| D719,780 | S | 12/2014 | Sullivan |
| 8,905,252 | B2 | 12/2014 | Latham et al. |
| 8,919,596 | B2 | 12/2014 | Carino |
| 8,960,506 | B2 | 2/2015 | Beilke et al. |
| D724,385 | S | 3/2015 | Hurley et al. |
| D724,435 | S | 3/2015 | Kaufman et al. |
| 8,967,414 | B2 | 3/2015 | Lane |
| 8,985,406 | B2 | 3/2015 | Tachi |
| D728,315 | S | 5/2015 | Bo |
| D728,995 | S | 5/2015 | Barberi |
| D729,579 | S | 5/2015 | Molayem |
| D729,584 | S | 5/2015 | Weston et al. |
| D732,402 | S | 6/2015 | Jones et al. |
| D734,154 | S | 7/2015 | Johnson et al. |
| D734,638 | S | 7/2015 | Wahl |
| D735,033 | S | 7/2015 | Lynd et al. |
| D735,038 | S | 7/2015 | Tamarindo |
| D735,578 | S | 8/2015 | Mazurkiewicz et al. |
| 9,113,698 | B2 | 8/2015 | Blain et al. |
| D738,670 | S | 9/2015 | Sands |
| 9,126,731 | B2 | 9/2015 | Chen |
| D741,655 | S | 10/2015 | Whelan et al. |
| 9,162,806 | B2 | 10/2015 | Fishel et al. |
| D743,255 | S | 11/2015 | Niggemyer |
| D743,742 | S | 11/2015 | Rummel et al. |
| D744,781 | S | 12/2015 | Rummel et al. |
| 9,205,445 | B2 | 12/2015 | Fang et al. |
| 9,215,942 | B2 | 12/2015 | Bodum |
| D748,472 | S | 2/2016 | Seybel et al. |
| D748,955 | S | 2/2016 | Oliver |
| D751,345 | S | 3/2016 | Lane et al. |
| D751,399 | S | 3/2016 | Lynd et al. |
| D751,898 | S | 3/2016 | D'Anglade |
| 9,272,822 | B2 | 3/2016 | Samartgis |
| 9,295,350 | B2 | 3/2016 | Smith et al. |
| D754,472 | S | 4/2016 | Munari |
| 9,302,827 | B1 | 4/2016 | Goss et al. |
| 9,321,565 | B2 | 4/2016 | Yamada et al. |
| D755,561 | S | 5/2016 | Eyal |
| D755,562 | S | 5/2016 | Lindsay |
| D757,543 | S | 5/2016 | Sorensen et al. |
| 9,346,591 | B2 | 5/2016 | Martinengo |
| D758,136 | S | 6/2016 | Liotta et al. |
| D758,790 | S | 6/2016 | Boroski |
| D758,791 | S | 6/2016 | Hanna et al. |
| D758,804 | S | 6/2016 | Liotta et al. |
| D758,859 | S | 6/2016 | Sorensen et al. |
| D759,487 | S | 6/2016 | Jayakaran |
| 9,376,243 | B2 | 6/2016 | Cerveny |
| D760,586 | S | 7/2016 | Seiders et al. |
| D761,624 | S | 7/2016 | McLean et al. |
| D762,418 | S | 8/2016 | Sorensen et al. |
| D763,076 | S | 8/2016 | Lane et al. |
| D764,916 | S | 8/2016 | Mount, III et al. |
| D766,668 | S | 9/2016 | Garcia |
| D767,390 | S | 9/2016 | Miksovsky et al. |
| D772,021 | S | 11/2016 | Joy |
| D772,652 | S | 11/2016 | Yao |
| D772,718 | S | 11/2016 | Lee |
| 9,493,274 | B2 | 11/2016 | Ledun et al. |
| 9,493,283 | B2 | 11/2016 | Tuyn |
| D773,250 | S | 12/2016 | Miller |
| D773,938 | S | 12/2016 | Weber |
| D774,826 | S | 12/2016 | Boroski |
| 9,522,770 | B2 | 12/2016 | Pichrt |
| 9,532,671 | B2 | 1/2017 | Lin |
| D778,117 | S | 2/2017 | Du |

(56) References Cited

U.S. PATENT DOCUMENTS

| | | | |
|---|---|---|---|
| D778,118 | S | 2/2017 | Du |
| D778,725 | S | 2/2017 | Sorensen et al. |
| 9,573,738 | B1 | 2/2017 | Lai |
| 9,586,733 | B2 | 3/2017 | Garza |
| D784,093 | S | 4/2017 | Boroski et al. |
| D784,812 | S | 4/2017 | Miller |
| D786,012 | S | 5/2017 | Hein et al. |
| D787,893 | S | 5/2017 | Seiders et al. |
| D787,894 | S | 5/2017 | Seiders et al. |
| D790,913 | S | 7/2017 | Stover et al. |
| D791,542 | S | 7/2017 | Miksovsky et al. |
| D792,765 | S | 7/2017 | Buck |
| 9,694,953 | B2 | 7/2017 | Meyers et al. |
| 9,708,108 | B2 | 7/2017 | Gregory et al. |
| D795,008 | S | 8/2017 | Eyal |
| D795,705 | S | 8/2017 | Huang |
| 9,745,110 | B2 | 8/2017 | Boyer et al. |
| D797,557 | S | 9/2017 | Ziccardi |
| 9,771,189 | B2 | 9/2017 | Miksovsky et al. |
| D799,269 | S | 10/2017 | Vargo |
| D799,909 | S | 10/2017 | Partridge |
| D799,963 | S | 10/2017 | Akiyama |
| 9,801,969 | B2 | 10/2017 | Griffis |
| D802,375 | S | 11/2017 | Kao |
| D802,419 | S | 11/2017 | Seiders et al. |
| D802,994 | S | 11/2017 | Seiders et al. |
| D804,240 | S | 12/2017 | Freeman |
| D804,256 | S | 12/2017 | Seiders et al. |
| D806,465 | S | 1/2018 | Boroski |
| D806,468 | S | 1/2018 | Goodwin et al. |
| D806,543 | S | 1/2018 | Finkbohner et al. |
| D808,731 | S | 1/2018 | Boroski et al. |
| 9,856,052 | B2 | 1/2018 | O'Leary et al. |
| 9,908,669 | B2 | 3/2018 | Stratton |
| 9,919,860 | B2 | 3/2018 | Dabah et al. |
| 9,926,115 | B2 | 3/2018 | Jung et al. |
| D814,852 | S | 4/2018 | Melanson et al. |
| D814,930 | S | 4/2018 | Tremayne et al. |
| 9,944,010 | B2 | 4/2018 | Matsuo et al. |
| D816,400 | S | 5/2018 | Beckman |
| D816,426 | S | 5/2018 | Washburn et al. |
| D817,114 | S | 5/2018 | Beckman |
| D818,775 | S | 5/2018 | Woodruff |
| D819,402 | S | 6/2018 | Silsby et al. |
| D819,443 | S | 6/2018 | Martinez Carregui et al. |
| D820,039 | S | 6/2018 | Fitzsimons |
| D824,217 | S | 7/2018 | Seiders et al. |
| 10,029,832 | B2 | 7/2018 | Isogai |
| D826,511 | S | 8/2018 | Ching |
| 10,040,593 | B2 | 8/2018 | Ross et al. |
| D831,434 | S | 10/2018 | Washburn et al. |
| 10,086,980 | B2 | 10/2018 | Isogai |
| D832,700 | S | 11/2018 | Seiders et al. |
| D832,704 | S | 11/2018 | Seiders et al. |
| D834,938 | S | 12/2018 | Barnes et al. |
| D835,937 | S | 12/2018 | Nichols |
| D836,387 | S | 12/2018 | Silsby et al. |
| D836,388 | S | 12/2018 | Abante et al. |
| D836,389 | S | 12/2018 | Abante et al. |
| D839,057 | S | 1/2019 | Jacobsen |
| 10,167,118 | B1 | 1/2019 | Piscopo |
| 10,167,120 | B1 | 1/2019 | Levy et al. |
| 10,183,791 | B2 | 1/2019 | Friedrich et al. |
| 10,189,619 | B1 | 1/2019 | Crawley |
| D839,684 | S | 2/2019 | Jacobsen |
| D839,685 | S | 2/2019 | Jacobsen |
| 10,196,179 | B2 | 2/2019 | Wisniewski |
| 10,196,185 | B2 | 2/2019 | Zoppas |
| 10,196,186 | B2 | 2/2019 | Cox |
| 10,196,187 | B2 | 2/2019 | Hingorani |
| 10,202,224 | B2 | 2/2019 | Painchaud |
| 10,214,323 | B2 | 2/2019 | Conley et al. |
| D842,030 | S | 3/2019 | Meyers |
| D842,038 | S | 3/2019 | Seiders et al. |
| D845,084 | S | 4/2019 | Jacobsen |
| 10,301,083 | B2 | 5/2019 | Crawford |
| 10,336,514 | B1 | 7/2019 | Briggs et al. |
| 10,351,319 | B1 | 7/2019 | Mizer et al. |
| D860,716 | S | 9/2019 | Abante et al. |
| 10,457,450 | B2 | 10/2019 | Rios |
| D866,334 | S | 11/2019 | Wieland et al. |
| D869,241 | S | 12/2019 | Ellison et al. |
| 10,512,347 | B1 | 12/2019 | Shepard et al. |
| D876,905 | S | 3/2020 | Seiders et al. |
| D878,166 | S | 3/2020 | Rane et al. |
| D880,230 | S | 4/2020 | Jacobsen |
| 10,633,150 | B2 | 4/2020 | Webber et al. |
| D883,737 | S | 5/2020 | Bullock et al. |
| D883,738 | S | 5/2020 | Bullock et al. |
| D885,903 | S | 6/2020 | Rane et al. |
| D887,266 | S | 6/2020 | Hudson et al. |
| D887,776 | S | 6/2020 | Bo |
| D887,793 | S | 6/2020 | Rane et al. |
| D888,508 | S | 6/2020 | Rane et al. |
| D888,509 | S | 6/2020 | Rane et al. |
| 10,689,168 | B2 | 6/2020 | Stolle |
| 10,698,368 | B2 | 6/2020 | Briggs et al. |
| D891,858 | S | 8/2020 | Adams, Jr. et al. |
| D892,561 | S | 8/2020 | Wang et al. |
| D897,151 | S | 9/2020 | Bullock et al. |
| D899,871 | S | 10/2020 | Seiders et al. |
| D902,655 | S | 11/2020 | Wang et al. |
| 10,894,650 | B1 | 1/2021 | Robinson et al. |
| 11,021,314 | B2 | 6/2021 | Tolman et al. |
| D934,033 | S | 10/2021 | Seiders et al. |
| 11,273,460 | B1 | 3/2022 | Dolph et al. |
| 11,278,139 | B2 | 3/2022 | Sorensen et al. |
| D960,660 | S | 8/2022 | Seiders et al. |
| D962,706 | S | 9/2022 | Smith et al. |
| D968,909 | S | 11/2022 | Wood |
| D973,447 | S | 12/2022 | Seymour |
| 11,524,833 | B2 | 12/2022 | Tolman et al. |
| D987,431 | S | 5/2023 | Bauer et al. |
| D1,011,883 | S | 1/2024 | Humphrey et al. |
| D1,015,803 | S | 2/2024 | Henkel |
| D1,018,214 | S | 3/2024 | Seiders et al. |
| 2002/0014498 | A1 | 2/2002 | Forsman et al. |
| 2003/0141321 | A1 | 7/2003 | Sekendur |
| 2003/0155323 | A1 | 8/2003 | Ekkert |
| 2004/0016715 | A1 | 1/2004 | Strikovic |
| 2004/0045967 | A1 | 3/2004 | Becker et al. |
| 2004/0094552 | A1 | 5/2004 | Featherston et al. |
| 2004/0099674 | A1 | 5/2004 | McDonough et al. |
| 2004/0201224 | A1 | 10/2004 | Chang |
| 2004/0206721 | A1 | 10/2004 | Swanberg et al. |
| 2005/0035158 | A1 | 2/2005 | Benoit-Gonin et al. |
| 2005/0274741 | A1 | 12/2005 | Cho |
| 2006/0180585 | A1 | 8/2006 | Cunningham et al. |
| 2006/0180613 | A1 | 8/2006 | Manesis |
| 2007/0051727 | A1 | 3/2007 | Holley, Jr. |
| 2007/0108153 | A1 | 5/2007 | Weist |
| 2007/0199914 | A1 | 8/2007 | Hung |
| 2007/0251956 | A1 | 11/2007 | Wasserman et al. |
| 2008/0142466 | A1 | 6/2008 | Balitski |
| 2008/0149651 | A1 | 6/2008 | Samson |
| 2008/0230506 | A1 | 9/2008 | Lantz et al. |
| 2009/0045194 | A1 | 2/2009 | Rhee |
| 2009/0084752 | A1 | 4/2009 | Coulson |
| 2009/0101644 | A1 | 4/2009 | Maiwald et al. |
| 2010/0012615 | A1 | 1/2010 | Brooks |
| 2010/0044389 | A1 | 2/2010 | Logue |
| 2010/0089151 | A1 | 4/2010 | Mantilla et al. |
| 2010/0200602 | A1 | 8/2010 | Chan |
| 2010/0215294 | A1 | 8/2010 | Berman |
| 2010/0237078 | A1 | 9/2010 | Lentz et al. |
| 2011/0036836 | A1 | 2/2011 | Lantheaume |
| 2011/0056386 | A1 | 3/2011 | Taketani |
| 2011/0186585 | A1 | 8/2011 | Lu |
| 2011/0198352 | A1 | 8/2011 | Lown et al. |
| 2011/0220656 | A1 | 9/2011 | Gau |
| 2011/0278216 | A1 | 11/2011 | Hull et al. |
| 2012/0031902 | A1 | 2/2012 | Gilbert |
| 2012/0074143 | A1 | 3/2012 | Lin |
| 2012/0199548 | A1 | 8/2012 | Kitto |

(56) References Cited

U.S. PATENT DOCUMENTS

| | | | |
|---|---|---|---|
| 2012/0312031 | A1 | 12/2012 | Olsen et al. |
| 2013/0008919 | A1 | 1/2013 | Honan et al. |
| 2013/0136382 | A1 | 5/2013 | Barron |
| 2013/0306642 | A1 | 11/2013 | Dabah et al. |
| 2014/0069917 | A1 | 3/2014 | Meyers et al. |
| 2014/0251938 | A1 | 9/2014 | Rose et al. |
| 2014/0312077 | A1 | 10/2014 | Tajima et al. |
| 2014/0319143 | A1 | 10/2014 | Connors, Jr. et al. |
| 2014/0353275 | A1 | 12/2014 | Hung |
| 2015/0191293 | A1 | 7/2015 | Forcella |
| 2015/0232232 | A1 | 8/2015 | Shibuki et al. |
| 2015/0251812 | A1 | 9/2015 | Gillie |
| 2015/0314929 | A1 | 11/2015 | Tebbe et al. |
| 2015/0374151 | A1 | 12/2015 | Lin |
| 2016/0159538 | A1 | 6/2016 | Michie |
| 2016/0167852 | A1 | 6/2016 | Moradi |
| 2016/0176587 | A1 | 6/2016 | Heraud |
| 2016/0192797 | A1 | 7/2016 | Yang |
| 2016/0256359 | A1 | 9/2016 | Trawick et al. |
| 2016/0318693 | A1 | 11/2016 | Hein et al. |
| 2016/0355305 | A1 | 12/2016 | Hoskins |
| 2016/0368663 | A1 | 12/2016 | Hizon |
| 2017/0001772 | A1 | 1/2017 | Rho |
| 2017/0043916 | A1 | 2/2017 | Seiders et al. |
| 2017/0081090 | A1 | 3/2017 | Boyer et al. |
| 2017/0119212 | A1 | 5/2017 | Petrillo et al. |
| 2017/0127859 | A1 | 5/2017 | Hornung et al. |
| 2017/0144811 | A1 | 5/2017 | Wohlgenannt |
| 2017/0158398 | A1 | 6/2017 | Shively |
| 2017/0158412 | A1 | 6/2017 | Seiders et al. |
| 2017/0354289 | A1 | 12/2017 | Marina et al. |
| 2018/0029762 | A1 | 2/2018 | Eyal |
| 2018/0050845 | A1 | 2/2018 | Chin et al. |
| 2018/0105346 | A1 | 4/2018 | Tolman et al. |
| 2018/0118427 | A1 | 5/2018 | Lee et al. |
| 2018/0134457 | A1 | 5/2018 | Mutterle et al. |
| 2018/0141722 | A1 | 5/2018 | Langelaan |
| 2018/0162608 | A1 | 6/2018 | Kim |
| 2018/0162610 | A1 | 6/2018 | Kim |
| 2018/0265264 | A1 | 9/2018 | Graybill et al. |
| 2019/0002164 | A1 | 1/2019 | Nakatani et al. |
| 2019/0039782 | A1 | 2/2019 | Campbell |
| 2019/0047754 | A1 | 2/2019 | Dubiel et al. |
| 2019/0047773 | A1 | 2/2019 | Bullock et al. |
| 2019/0062010 | A1 | 2/2019 | Apte et al. |
| 2019/0210775 | A1 | 7/2019 | Brown |
| 2020/0245818 | A1 | 8/2020 | Halkes et al. |
| 2020/0245858 | A1 | 8/2020 | Takeno et al. |
| 2021/0206539 | A1 | 7/2021 | Lovern, IV et al. |
| 2022/0097916 | A1 | 3/2022 | Smith et al. |

FOREIGN PATENT DOCUMENTS

| | | | |
|---|---|---|---|
| AU | 2017280047 | A1 | 1/2019 |
| AU | 2016368382 | B2 | 2/2019 |
| AU | 2019101119 | A4 | 10/2019 |
| CA | 1321776 | C | 8/1993 |
| CA | 2504722 | A1 | 1/2006 |
| CA | 2567706 | C | 1/2013 |
| CA | 3030583 | A1 | 11/2018 |
| CA | 3012127 | A1 | 2/2019 |
| CA | 174841 | S | 1/2020 |
| CA | 3009405 | C | 9/2020 |
| CA | 201651 | S | 10/2022 |
| CA | 202000 | S | 11/2022 |
| CH | 1380800001 | S1 | 7/2011 |
| CN | 1244846 | A | 2/2000 |
| CN | 201019201 | Y | 2/2008 |
| CN | 300984030 | | 8/2009 |
| CN | 201349991 | Y | 11/2009 |
| CN | 301110494 | | 1/2010 |
| CN | 201640878 | U | 11/2010 |
| CN | 101945812 | A | 1/2011 |
| CN | 201694495 | U | 1/2011 |
| CN | 201734576 | U | 2/2011 |
| CN | 201777557 | U | 3/2011 |
| CN | 202030152 | U | 11/2011 |
| CN | 202060630 | U | 12/2011 |
| CN | 202086330 | U | 12/2011 |
| CN | 102307497 | A | 1/2012 |
| CN | 301888124 | S | 4/2012 |
| CN | 202287503 | U | 7/2012 |
| CN | 302228747 | S | 12/2012 |
| CN | 103112651 | A | 5/2013 |
| CN | 202981686 | U | 6/2013 |
| CN | 203127394 | U | 8/2013 |
| CN | 203199308 | U | 9/2013 |
| CN | 203207847 | U | 9/2013 |
| CN | 103619723 | A | 3/2014 |
| CN | 104108520 | A | 10/2014 |
| CN | 104129579 | A | 11/2014 |
| CN | 203914463 | U | 11/2014 |
| CN | 102730301 | B | 3/2015 |
| CN | 303176279 | S | 4/2015 |
| CN | 103086061 | B | 8/2015 |
| CN | 103538798 | A | 9/2015 |
| CN | 303413115 | S | 10/2015 |
| CN | 303528321 | | 12/2015 |
| CN | 204979595 | U | 1/2016 |
| CN | 204979648 | U | 1/2016 |
| CN | 105705425 | A | 6/2016 |
| CN | 303748684 | S | 7/2016 |
| CN | 303894653 | | 10/2016 |
| CN | 303899030 | | 10/2016 |
| CN | 205697016 | U | 11/2016 |
| CN | 303902404 | | 11/2016 |
| CN | 303905254 | | 11/2016 |
| CN | 303905266 | | 11/2016 |
| CN | 303944047 | | 11/2016 |
| CN | 303956194 | | 12/2016 |
| CN | 303965272 | | 12/2016 |
| CN | 303965286 | | 12/2016 |
| CN | 303965392 | | 12/2016 |
| CN | 303965400 | | 12/2016 |
| CN | 303966239 | | 12/2016 |
| CN | 303974938 | | 12/2016 |
| CN | 303984407 | | 12/2016 |
| CN | 303984493 | | 12/2016 |
| CN | 106263476 | A | 1/2017 |
| CN | 304011213 | | 1/2017 |
| CN | 304011214 | | 1/2017 |
| CN | 304025064 | S | 2/2017 |
| CN | 205998332 | U | 3/2017 |
| CN | 206202961 | U | 5/2017 |
| CN | 304174286 | S | 6/2017 |
| CN | 206813608 | U | 12/2017 |
| CN | 207041437 | U | 2/2018 |
| CN | 108137191 | A | 6/2018 |
| CN | 108313494 | A | 7/2018 |
| CN | 107224167 | B | 8/2018 |
| CN | 108394633 | A | 8/2018 |
| CN | 108471910 | A | 8/2018 |
| CN | 304799330 | S | 9/2018 |
| CN | 106458394 | B | 10/2018 |
| CN | 105050907 | B | 12/2018 |
| CN | 105358441 | B | 12/2018 |
| CN | 108945789 | A | 12/2018 |
| CN | 106163937 | B | 1/2019 |
| CN | 105595863 | B | 2/2019 |
| CN | 106255648 | B | 2/2019 |
| CN | 106414269 | B | 2/2019 |
| CN | 106458396 | B | 2/2019 |
| CN | 109319295 | A | 2/2019 |
| CN | 208470495 | U | 2/2019 |
| CN | 208485029 | U | 2/2019 |
| CN | 208531194 | U | 2/2019 |
| CN | 305248333 | S | 7/2019 |
| CN | 210276755 | U | 4/2020 |
| CN | 212448714 | U | 2/2021 |
| CN | 306635234 | S | 6/2021 |
| CN | 306807664 | S | 9/2021 |
| CN | 214987304 | U | 12/2021 |
| CN | 307080421 | S | 1/2022 |
| CN | 307092037 | S | 1/2022 |

(56) References Cited

FOREIGN PATENT DOCUMENTS

| | | | |
|---|---|---|---|
| CN | 307177266 | S | 3/2022 |
| CN | 307209145 | S | 3/2022 |
| CN | 307209146 | S | 3/2022 |
| CN | 307321161 | S | 5/2022 |
| CN | 307388266 | S | 6/2022 |
| CN | 307478808 | S | 8/2022 |
| CN | 307535910 | S | 9/2022 |
| CN | 307553570 | S | 9/2022 |
| CN | 307866948 | S | 9/2022 |
| CN | 307535914 | S | 10/2022 |
| CN | 307584616 | S | 10/2022 |
| CN | 307584617 | S | 10/2022 |
| CN | 307584653 | S | 10/2022 |
| CN | 307590815 | S | 10/2022 |
| CN | 307614407 | S | 10/2022 |
| CN | 307619842 | S | 10/2022 |
| CN | 307620098 | S | 10/2022 |
| CN | 307642519 | S | 11/2022 |
| CN | 307676278 | S | 11/2022 |
| CN | 307710601 | S | 12/2022 |
| CN | 307722462 | S | 12/2022 |
| CN | 307766731 | S | 1/2023 |
| CN | 307773605 | S | 1/2023 |
| CN | 307780074 | S | 1/2023 |
| CN | 307780144 | S | 1/2023 |
| CN | 307788631 | S | 1/2023 |
| CN | 307788635 | S | 1/2023 |
| CN | 307825484 | S | 2/2023 |
| CN | 307868100 | S | 2/2023 |
| CN | 307884737 | S | 3/2023 |
| CN | 307893947 | S | 3/2023 |
| DE | 2233565 | A1 | 6/1973 |
| DE | 2226556 | B2 | 8/1977 |
| DE | 3514261 | A1 | 1/1986 |
| DE | 29612345 | U1 | 9/1996 |
| DE | 29611746 | U1 | 11/1997 |
| DE | 29720426 | U1 | 4/1998 |
| DE | 69509827 | T2 | 10/1999 |
| DE | 29912668 | U1 | 12/1999 |
| DE | 202008009584 | U1 | 10/2008 |
| DE | 102014011506 | B3 | 7/2015 |
| DK | 402016101176-0008 | | 11/2016 |
| DK | 402016101176-0010 | | 11/2016 |
| EM | 0005444160001 | A1 | 8/2006 |
| EM | 0017252430001 | A1 | 7/2010 |
| EM | 002759605 | A1 | 10/2015 |
| EM | 003528504-0004 | | 12/2016 |
| EM | 004539732-0003 | | 12/2017 |
| EM | 0091870080001 | S | 10/2022 |
| EP | 1088764 | A1 | 4/2001 |
| EP | 0681441 | B1 | 11/2005 |
| EP | 1693310 | A1 | 8/2006 |
| EP | 1878667 | A1 | 1/2008 |
| EP | 1934106 | A1 | 6/2011 |
| EP | 2457842 | B1 | 5/2015 |
| EP | 3066018 | A4 | 11/2016 |
| EP | 2851311 | B1 | 6/2018 |
| EP | 3157833 | A | 8/2018 |
| EP | 2796078 | B1 | 10/2018 |
| EP | 3398484 | A1 | 11/2018 |
| EP | 3398871 | A1 | 11/2018 |
| EP | 3441320 | A1 | 2/2019 |
| EP | 3426563 | A4 | 10/2019 |
| FR | 1359912 | A | 4/1964 |
| FR | 2521957 | B1 | 10/1986 |
| FR | 2786465 | | 6/2000 |
| FR | 2830848 | A1 | 4/2003 |
| FR | 20214014001 | S1 | 2/2022 |
| GB | 729903 | A | 5/1955 |
| GB | 2114959 | B | 7/1985 |
| GB | 2438391 | B | 1/2012 |
| GB | 6188752 | S | 2/2022 |
| JP | S50-64 | A | 1/1975 |
| JP | S59044941 | U | 3/1984 |
| JP | 1987052853 | A | 3/1987 |
| JP | H02-052759 | U | 4/1990 |
| JP | H03159974 | U | 7/1991 |
| JP | H08-0117119 | A | 5/1996 |
| JP | 2000333847 | A | 12/2000 |
| JP | 2001315831 | A | 11/2001 |
| JP | 2002068227 | A | 3/2002 |
| JP | 2002145294 | A | 5/2002 |
| JP | 2002284176 | A | 10/2002 |
| JP | 2002321755 | A | 11/2002 |
| JP | 2003125912 | A | 5/2003 |
| JP | 2006230731 | A | 9/2006 |
| JP | 2008162679 | A | 7/2008 |
| JP | 1363566 | | 6/2009 |
| JP | 2010280402 | A | 12/2010 |
| JP | 2011093544 | A | 5/2011 |
| JP | 2012025436 | A | 2/2012 |
| JP | 2012517386 | A | 8/2012 |
| JP | 2014210136 | A | 11/2014 |
| JP | 1530358 | S | 8/2015 |
| JP | 2016141412 | A | 8/2016 |
| JP | 6408837 | B2 | 10/2018 |
| JP | 6409250 | B1 | 10/2018 |
| JP | 2019001538 | A | 1/2019 |
| JP | 6467720 | B2 | 2/2019 |
| JP | 2019503943 | A | 2/2019 |
| JP | 1725331 | S | 9/2022 |
| JP | 7225651 | B2 | 2/2023 |
| KR | 300151505 | S | 6/1994 |
| KR | 3001515050001 | S | 6/1994 |
| KR | 200169857 | Y1 | 2/2000 |
| KR | 300295354 | | 4/2002 |
| KR | 300303813.0000 | | 8/2002 |
| KR | 100908999 | B1 | 7/2009 |
| KR | 20100008131 | A | 1/2010 |
| KR | 300636271 | S | 3/2012 |
| KR | 300764889.0000 | | 10/2014 |
| KR | 3007776150001 | S | 3/2015 |
| KR | 3020150002495 | | 12/2015 |
| KR | 101581270 | B1 | 1/2016 |
| KR | 30-0847946 | | 4/2016 |
| KR | 101668309 | B1 | 10/2016 |
| KR | 300883384.0000 | | 11/2016 |
| KR | 300884377.0000 | | 12/2016 |
| KR | 300885455.0000 | | 12/2016 |
| KR | 300885851.0000 | | 12/2016 |
| KR | 300888536.0000 | | 1/2017 |
| KR | 101785906 | B1 | 10/2017 |
| KR | 1020170123187 | A | 11/2017 |
| KR | 20-2019-0000204 | U | 1/2019 |
| KR | 101922235 | B1 | 2/2019 |
| KR | 301014708 | S | 7/2019 |
| KR | 301197177 | S | 12/2022 |
| NZ | 766884 | A | 3/2021 |
| RU | 00100680 | | 11/2016 |
| WO | 2005028317 | A2 | 3/2005 |
| WO | 2006023238 | A2 | 3/2006 |
| WO | 07123365 | A1 | 11/2007 |
| WO | 08048039 | A1 | 4/2008 |
| WO | 2012022475 | A1 | 2/2012 |
| WO | 2014114493 | A1 | 7/2014 |
| WO | 14041325 | A3 | 9/2014 |
| WO | 14184341 | A1 | 11/2014 |
| WO | D088688-002 | | 1/2016 |
| WO | 16180908 | A1 | 11/2016 |
| WO | 17097485 | A1 | 6/2017 |
| WO | 17115193 | A1 | 7/2017 |
| WO | 2018075540 | A1 | 4/2018 |
| WO | 18149763 | A1 | 8/2018 |
| WO | 2018145645 | A1 | 8/2018 |
| WO | 2017/223093 | A3 | 2/2019 |
| WO | 2019025589 | A1 | 2/2019 |

OTHER PUBLICATIONS

Feb. 9, 2024—(AU) Examination Report 1—App. No. 2023200500.

"2015 Boulder Insulated Water Bottle with Tea, Fruit, Ice Strainer" published on Jun. 28, 2015, retrieved from http://web.archive.org/web/*/http://www.ecovessel.com/boulder-insulated-water-bottle-

(56) References Cited

OTHER PUBLICATIONS with-tea-fruit-ice-strainer-20-oz/ on Sep. 2022.
"64 oz Double-Wall Vacuum-Insulated Growler" published on Nov. 14, 2014, retrieved from https://web.archive.org/web/*/http://www.fiftyfiftybottles.com/64oz-growler/ on Sep. 22, 2016.
"Eco Vessel 64 ounce Growler" published on Jan. 28, 2015, retrieved from http://web.archive.org/web/*/http://www.snewsnet.com/press-release/eco-vessel-launches-the-boss-insulated-growler/ on Sep. 22, 2016.
'First Look: Yeti Rambler One Gallon 'Jug' Review'. Found online Jun. 12, 2017 at gearjunkie.com. Page dated May 2, 2017. Retrieved from https://gearjunkie.com/yeti-rambler-one-gallon-jug-review.
"Hydro Flask Insulated Stainless Steel Water Bottle" published on Dec. 29, 2014, retrieved from http://web.archive.org/web/*/https://www.amazon.com/dp/B004X55L9l/ref=twister_B00GA03LG4?_encoding=UTF8&psc=1 on Sep. 22, 2016.
"Igloo Sport Beverage Cooler". Found online Jun. 7, 2017 at amazon.com. Page dated Mar. 9, 2013. Retrieved from https://www.amazon.com/Igloo-Beverage-Cooler-Majestic-2-Gallon/dp/B0088AYPOG/ref=cm_cr_arp_d_product_top?ie=UTF8.
"KB8 20 oz. Double Wall Stainless Bottle," published on May 22, 2015, retrieved from https://web.archive.org/web/20150807054814/http://thermo-steel.com/work/keen-kb8 on Sep. 27, 2016.
"Klean Kanteen Insulated Classic with Polypropylene" published on Jul. 7, 2015, retrieved from http://web.archive.org/web/*/https://www.lifewithoutplastic.com/store/klean-kanteen-insulated-classic-with-polypropylene-loop-cap-0-95-l-32-oz.html on Sep. 22, 2016.
"Klean Kanteen Stainless Unibody Bamboo Cap". Found online Jun. 12, 2018 at amazon.com. Page dated Sep. 10, 2012. Retrieved from https://www.amazon.com/Klean-Kanteen-Stainless-Unibody-Bamboo/dp/B0083F0SDI/ref=cm_cr_arp_d_product_top?ie=UTF8.
"Klear Loop Cap Hangle Lids for Klear Bottle and Hydro Flask". Found online Jun. 7, 2017 at amazon.com. Page dated Jul. 4, 2016. Retrieved from https://www.amazon.com/Klear-Handle-Bottle-Hydro-Flask/dp/B01EXKSRLQ/ref=cm_cr_arp_d_product_top?ie=UTF8.
"Lifefactory Water Bottle with Flip Cap". Found online Oct. 26, 2016 at amazon.com. Page dated Jan. 21, 2012. Retrieved from https://www.amazon.com/Lifefactory-22-Ounce-BPA-Free-Bottle-Silicone/dp/B01JIHJYOI/ref=pd_day0_79_22?_encoding=UTF8&refRID=YW47QZQ73YFSYXXEHXG2.
"Stanley Classic Vacuum Bottle." Found online Jul. 13, 2018 at www.amazon.com. Page dated Nov. 30, 2014. Retrieved from URL: https://tinyurl.com/y8nnymt9 (Year: 2014).
"Takeya ThermoFlask". Found online Jun. 9, 2018 at amazon.com. Page dated Apr. 15, 2016. Retrieved from https://www.amazon.com/Takeya-ThermoFlask-Pack-Back-Silver/dp/B01D7NIOWW/ref=cm_cr_arp_d_product_top?ie=UTF8.
"Thermos Stainless King 60 Ounce Vacuum Insulated Beverage Bottle." Found online Jul. 13, 2018 at www.amazon.com. Page dated Aug. 15, 2015. Retrieved from U RL: https://www.amazon.com/Thermos-Stainless-Insulated-Beverage-Midnight/dp/B008YB4V52 (Year: 2015).
"Twitter: h2go elevate and h2go inspire: same lid style, different body type". Found online Jun. 12, 2018 at twitter.com. Page dated Jan. 21, 2015. Retrieved from https://twitter.com/etsexpress/status/557997114589196288.
"UA Beyond 18 oz. Vacuum Insulated Water Bottle" published on Mar. 29, 2015, retrieved from http://web.archive.org/web/*/https://www.underarmour.com/en-us/beyond-18-oz-vacuum-insulated-ss-bottle-with-flip-top-lid/pid1232014 on Sep. 22, 2016.
"Yeti Rambler Bottle Cup Cap Accessory." Found online: Jun. 18, 2019 at www.amazon.com. Product reviewed May 30, 2019. Retrieved from URL: http://tinyurl.com/y32g688u (Year: 2019).
Nov. 1, 2016—(JP) Office Action—App. 2016-9606, English Translation, 2 Pages.
Nov. 2, 2016—(WO) International Search Report and Written Opinion—App. No. PCT/US2016/047043.
Oct. 4, 2016—(JP) Office Action—App 2016-9607, English Translation, 2 pages.
Oct. 4, 2016—(JP) Office Action—App. 2016-9608, English Translation, 2 Pages.
Oct. 18, 2016—(JP) Office Action—App. 2016-010799, English Translation, 3 Pages.
Oct. 18, 2016—(JP) Office Action—App. 2016-010800, English Translation, 3 Pages.
Jan. 29, 2018—(WO) Invitation to Pay Additional Fees and Partial International Search Report—App. No. PCT/US2017/057010—13 pages.
Mar. 27, 2018—(WO) International Search Report and Written Opinion—App. No. PCT/US2017/057010—19 pages.
Dec. 4, 2019—(CN) Examination Report—App. No. 201680059619.7.
Feb. 11, 2019—(CN) Office Action—App. No. 201680059619.7.
Jul. 15, 2019—(CN) Office Action—App. No. 201680059619.7.
Apr. 6, 2020—(WO) International Search Report & Written Opinion—PCT/US19/056566.
Feb. 19, 2020—(EP) Extended Search Report—App No. EP19209538 (006591.03450).
Jul. 23, 2020—(US) Final Office Action—U.S. Appl. No. 15/786,163.
May 19, 2020—(CN) Office Action—App. No. 201680059619.7.
May 7, 2020—(WO) ISR & Written Opinion—PCT/US19/059799.
Jan. 4, 2021—(CN) Fourth Office Action—App. No. 201680059619.7.
Avex, "40oz. 3Sixty Pour Stainless Steel Thermal Bottle", Accessed May 18, 2017. http://www.avexoutdoor.com/3sixty-pour-realtree-thermal-bottle.html.
Kold Vacuum Insulated Stainless Steel Sports Bottle: Announced Dec. 8, 2015 [online], site visited [May 11, 2016]. Available from Internet URL: http://www.amazon.com/KOLD-Sports-Water-Bottles-Insulated/dp/B018YH K79E/ref=cm.
Liquid Hardware, Insulated Aqua Silver Sidewinder Vacuum Bottle 20oz./592ml. Powder Coated in USA!, product description, retrieved from internet on Aug. 12, 2015, 3 pages.
Rambler Jug Mount. Online, published date unknown. Retrieved on Jan. 2, 2018 from URL: https://www.yeti.com/accessories/rambler-jug-mount!YRAMJM.html.
Yeti 36 oz. Rambler: Announced Jan. 11, 2016 [online], site visited [May 10, 2016]. Available from Internet URL: http://yeticoolers.com/rambler-bottle-36-oz/.
Yeti Rambler Vacuum Insulated Stainless Steel One Gallon Jug with MagCap. Found online Jun. 12, 2017 at amazon.com. Page dated May 30, 2017. Retrieved from https://www.amazon.com/YETI-Rambler-Vacuum-Insulated-Stainless/dp/B071HTJ4Q8.
Youtube. Yeti Rambler R12 Bottle with Hotshot Cap Demo, Features & Review by Tentworld—The Camping Experts. Oct. 30, 2019. https://www.youtube.com/watch?v=cLZsvhUMydM (Year: 2019).
United States District Court Western District of Texas, Austin Division, "Complaint for Damages and Injunctive Relief tor: (1)-(12) Patent Infringement in Violation of 35 U.S.C. § 271; and (13) Breach of Contract", *Yeti Coolers, LLC* v. *RTIC Outdoors, LLC; and Corporate Support & Fulfillment, LLC*, Case 1:21-cv-00214, filed Mar. 5, 2021, 338 pages.
Jan. 29, 2021 (CN) Chinese Evaluation Report app No. 201930169002.7.
United States District Court Western District of Texas, Austin Division, "First Amended Complaint, 'Complaint for Damages and Injunctive Relief for: (1)-(15) Patent Infringement in Violation of 35 U.S.C. § 271; and (16) Breach of Contract'", *Yeti Coolers, LLC* v. *RTIC Outdoors, LLC; and Corporate Support & Fulfillment, LLC*, Case 1:21-cv-00214-RP, Document 10, filed Jun. 2, 2021, 39 pages.
United States District Court Western District of Texas, Austin Division, "Answer of Defendants RTIC Outdoors, LLC and Corporate Support & Fulfillment, LLC to Yeti's Amended Complaint: (1)-(15) Patent Infringement in Violation of 35 U.S.C. § 271; and (16) Breach of Contract", *Yeti Coolers, LLC* v. *RTIC Outdoors, LLC; and Corporate Support & Fulfillment, LLC*, Case 1:21-cv-00214-RP, Document 16, filed Jun. 17, 2021, 79 pages.
"History of Thermos", https://www.thermos.com/history.
Jun. 3, 2021—(CN) Fifth Office Action—App. No. 201680059619.7.

(56) References Cited

OTHER PUBLICATIONS

Amazon. Yeti Rambler 12 oz Bottle, Stainless Steel, Vacuum Insulated, with Hot Shot Cap. Apr. 4, 2019. https://www.amazon.com/YETI-Rambler-Stainless-Vacuum-Insulated/dp/B07QD7Z2ZP (Year: 2019).
Sep. 23, 2021—(CN) First Office Action—App. No. 201780064159.1.
Oct. 19, 2021—(JP) Office Action—App. No. 2019542349.
Dec. 6, 2023—(JP) First Office Action—App. No. 2022-172218.
Dec. 13, 2023—(JP) First Office Action—App. No. 2022-171166.
Amazon. Yeti Rambler Bottle Hot Shot Cap Accessory, Video "Yeti Hotshot Cap". Aug. 1, 2018. https://www.amazon.com/ YETI-Bottle-Shot-Rambler-Each/dp/B07G3BW24T (Year: 2018).
United States District Court Western District of Texas, Austin Division, "Second Amended Complaint", *Yeti Coolers, LLC* v. *RTIC Outdoors, LLC; and Corporate Support & Fulfillment, LLC*, Case 1:21-cv-00214-RP, Document 33, filed Dec. 17, 2021, 489 pages.
United Stated District Court Western District of Texas, Austin Division, "Answer of Defendants RTIC Outdoors, LLC and Corporate Support & Fulfillment, LLC to Yeti's Second Amended Complaint, Jury Trial Demanded", *Yeti Coolers, LLC* v. *RTIC Outdoors, LLC; and Corporate Support & Fulfillment, LLC*, Case 1:21-cv-00214-RP, Document 34, filed Jan. 3, 2022, 92 pgs.
United States District Court Western District of Texas Austin Division, "Defendants RTIC Outdoors, LLC's and Corporate Support & Fulfillment, LLC's Invalidity Contentions", *Yeti Coolers, LLC* v. *RTIC Outdoors, LLC and Corporate Support & Fulfillment, LLC*, Case No. 1:21-cv-00214, Jury Trial Demanded, filed Jan. 17, 2022, 3173 pages.
Mar. 30, 2022—(AU) Examination Report No. 1—App. No. 2019374770.
Thermos Icy Hot Bottle and Jumbo Jug, "History of Thermos" (6 pgs), U.S. District Court Western District of Texas, "Defendants RTIC Outdoors, LLC's and Corporate Support & Fulfillment, LLC's Invalidity Contentions", *Yeti Coolers, LLC* v. *RTIC Outdoors, LLC*, Case No. 1:21-cv-00214, dated Jan. 17, 2022, p. 27.
Apr. 14, 2022—(AU) Examination Report No. 1—App. No. 2019359826.
Mar. 14, 2022—(EP) Extended Search Report—App. No. 21207878.6.
May 6, 2022—(CN) Second Office Action—App. No. 201780064159.1.
May 10, 2022—(JP) Office Action—Appl. No. 2021-521191.
May 27, 2022—(JP) Office Action—App. No. 2021-523912.
Aug. 22, 2022—(AU) Examination Report No. 2—App. No. 2019374770.
Aug. 17, 2022—(CA) Examiner's Report—App. No. 3118873.
Aug. 31, 2022—(AU) Examination Report 1—App. No. 2017346682.
Aug. 31, 2022—(AU) Examination Report No. 1—App. No. 2017346682.
Jul. 15, 2022—(CA) Office Action—App. No. 3116874.
Oct. 21, 2022—(MX) First Substantive Office Action—App. No. MX/A/2019/004520.
Nov. 15, 2022—(CN) First Office Action—App. No. 202111219424.3.
Nov. 2, 2022—(AU) Examination Report No. 2—App. No. 2019359826.
Dec. 23, 2022—(NZ) First Examination Report—App. No. 774979.
Jan. 27, 2023—(NZ) Examination Report No. 1—App. No. 775705.
Feb. 3, 2023—(JP) Office Action—App. No. 2022006119.
Feb. 14, 2023—(CA) Office Action—Ap. No. 3118873.
Jun. 16, 2023—(CN) Second Office Action—App. No. 202111219424.3.
Jul. 6, 2023—(NZ) Examination Report No. 2—App. No. 774979.
Aug. 26, 2023—(CN) Office Action—App. No. 201980068566.9.
Aug. 28, 2023—(CN) First Office Action—App. No. 201980072889.5.
Apr. 29, 2024—(MX) First Office Action—App. No. MX/a/2021/004340.
Apr. 27, 2024—(CN) Second Office Action—App. No. 201980072889.5.
Apr. 27, 2024—(CN) Second Office Action—App. No. 201980068566.9.
Apr. 15, 2024—(EP) Article 94(3) Communication—App. No. 19798791.0.
Mar. 27, 2024—(NZ) First Examination Report—App. No. 793305.
Amazon.com, Rangland Insulated 1 Gallon Water Bottle with Sleeve—Stainless Steel Wide Mouth Growler with Tactical Carrying Bag—Insulation for Hot/Cold Drinks (128 oz), visited Sep. 22, 2022.
Amazon.com, Civago Gallon Insulated Water Bottle Jug, 128 oz Stainless Steel Sports Canteen with Handle and Carrier Bag, Large Metal Growler Mug, Black, visited Sep. 22, 2022.
Amazon.com, Nature Pioneor 64/128 oz Vacuum Insulated Water Bottle Set with Carrying Holder, 18/8 Food Grade Stainless Steel One Gallon Jug, Beer Growler with Carrier Pouch for Outdoor Camping, visited Sep. 22, 2022.
Amazon.com, Coldest Sports Water Bottle Half Gallon, 64 oz, ½ Gallon (Straw Lid), Leak Proof, Vacuum Insulated Stainless Steel, Hot Cold, Double Walled, Thermo Mug, Metal Canteen Growler Jug, visited Sep. 22, 2022.
Amazon.com, Arslo Large Insulated Water Jug With Handle, One Gallon Insulated Water Bottle, 1 Gallon Stainless Steel Water Jug, Silver, 128 oz, visited Sep. 22, 2022.
Amazon.com, Buzio One Gallon Vacuum Insulated Jug, 18/8 Food-Grade Stainless Steel 128 oz Water Bottle Beer Growler Comes with Two Stainless Steel Cups Thermo Canteen Mug, Indigo Crush, visited Sep. 22, 2022.
Amazon.com, Sursip 128 oz Insulated Water Bottle, One Gallon, Vacuum Stainless Steel Double-Walled Water Jug with 1 pcs 30 oz Mug (Inclue/Brush/Straw)/Jug Backpack, Sports, Travel, Games, Home use, School-Wood Grain, visited Sep. 22, 2022.
Amazon.com, Tronco One Gallon Vacuum Insulated Bottle, 128 oz Stainless Steel Water Jug with Straw and 3 Cups, Sweat-Proof and Leak-Proof, Fit for Outdoor/Sport/Camping/Traveling/Gym/Gaming-Green Black, visited Sep. 22, 2022.
Amazon.com, Zenbo 128 oz Jug with Straw Keeps Cold up to 36 Hours, One Gallon Large Double Wall Vacuum Insulated Water Bottle, Sweat-Proof & Leak-Proof, visited Sep. 22, 2022.
Amazon.com, Hemli One Gallon Water Bottle Insulated, 128 oz Insulated Stainless Steel Water Bottle, One Gallon Jug, Double-Walled Vacuum-Sealed Insulated Beer Growler, with Carrying Case, visited Sep. 22, 2022.
RTIC, Insulated Jugs, Stainless Steel, Insulated, Reusable visited Sep. 22, 2022.
Advancedmixology.com, Begood Growler One Gallon Water Bottle Insulated, 18/8 Food-grade Stainless Steel, 128 oz Gallon Water Bottle Stainless Steel Jug, 1 Gallon Water Bottle Insulated, One Gallon Thermos Canteen (Black), visited Sep. 22, 2022.
Amazon.com, Muhu Ozark Trail ½ Gallon Double-Wall Vacuum-Sealed Stainless Steel Water Jug, visited Sep. 22, 2022.
Sep. 28, 2023—(CA) Office Action—App. No. 3040708.
Feb. 6, 2024—(AU) First Examination Report—App. No. 2023200658.
Jan. 30, 2024—(EP) First Examination Report—App. No. 198359259.
May 22, 2024—(JP) Second Office Action—App. No. 2022-171166.
Jul. 12, 2024—(CN) First Office Action—App. No. 202211447018.7.
Jul. 30, 2024—(CN) Decision of Rejection—App. No. 201980072889.5.
Jun. 11, 2024—(MX) First Office Action—App. No. MX/a/ 2021/005276.
"Insulated Hydro Jug 3.8L—Green", https://theaussiepal.com, retrieved Jun. 3, 2024, published date unkown, prior to the filing date of the present Application, URL: <https://url.us.m.mimecastprotect.com/s/mU48C68Y6MUG7j3YSpPs9G>.

CONTAINER WITH MAGNETIC CAP

CROSS-REFERENCE TO RELATED APPLICATIONS

This application is a continuation of U.S. patent application Ser. No. 17,677,637, filed Feb. 22, 2022, which is a continuation of U.S. patent application Ser. No. 17/152,503, filed Jan. 19, 2021, now U.S. Pat. No. 11,273,961, which is a continuation of U.S. patent application Ser. No. 16/154,178, filed Oct. 8, 2018, now U.S. Pat. No. 10,926,925, which is a continuation of U.S. patent application Ser. No. 14/826,612, filed Aug. 14, 2015, now U.S. Pat. No. 10,093,460, each of which is incorporated herein by reference in its entirety for any and all non-limiting purposes.

BACKGROUND

A container may be configured to store a volume of liquid. In one example, an opening in the container may be sealed with a removable cap. As such, in order to extract the liquid from the container, the cap may first be manually removed and set aside.

BRIEF SUMMARY

In certain examples, an insulating container may have a canister, which can include an insulated double wall, a first end to support the canister on a surface, a second end, and a sidewall. The canister may also have an opening in the second end that extends through the insulated double wall. A neck structure may encircle the opening and extend in an axial direction.

In certain examples, a lid may seal the opening of the canister, with a threaded sidewall of the lid received into the neck structure of the canister. The lid may also have a circular domed top surface having a spout opening, and a removable cap that seals the spout opening. Further, the cap may have a magnetic top surface configured to be magnetically attracted to, and retained within, an optional dimple on the domed top surface.

This Summary is provided to introduce a selection of concepts in a simplified form that are further described below in the Detailed Description. The Summary is not intended to identify key features or essential features of the claimed subject matter, nor is it intended to be used to limit the scope of the claimed subject matter.

BRIEF DESCRIPTION OF THE DRAWINGS

The present invention is illustrated by way of example and not limited in the accompanying figures in which like reference numerals indicate similar elements and in which.

Further, it is to be understood that the drawings may represent the scale of different components of one single embodiment; however, the disclosed embodiments are not limited to that particular scale.

DETAILED DESCRIPTION

Aspects of this disclosure relate to a container configured to store a volume of liquid. In one example, the container may have a spout opening that is sealed with a removable cap. Accordingly, the removable cap may be configured with a magnetic top surface such that when removed, the cap may be magnetically affixed to one or more surfaces of the container for temporary storage while the liquid is being poured from the container.

In the following description of the various embodiments, reference is made to the accompanying drawings, which form a part hereof, and in which is shown by way of illustration various embodiments in which aspects of the disclosure may be practiced. It is to be understood that other embodiments may be utilized and structural and functional modifications may be made without departing from the scope and spirit of the present disclosure.

Figure 1:
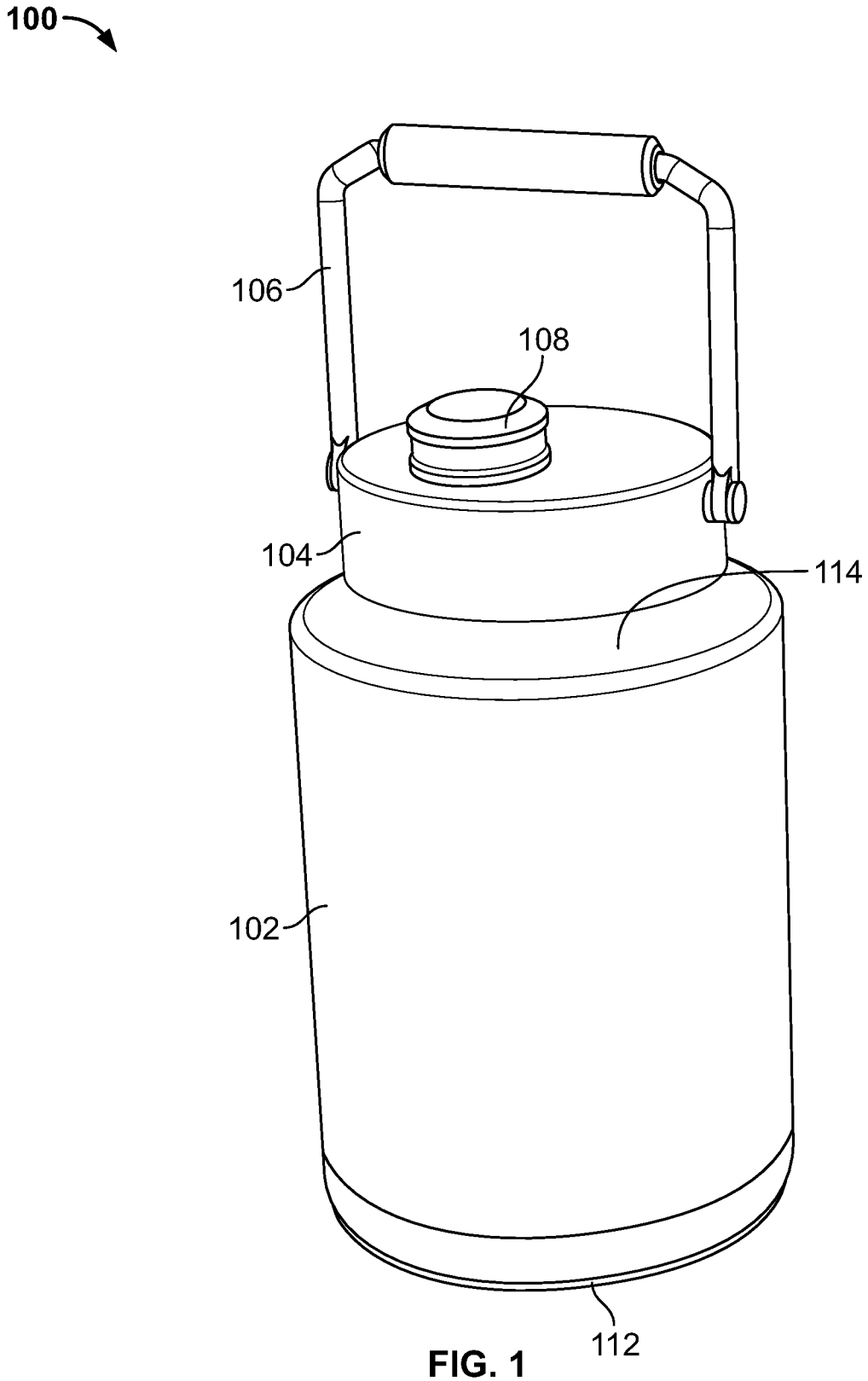
FIG. 1 depicts an isometric view of an example container, according to one or more aspects described herein.
Figure 3:
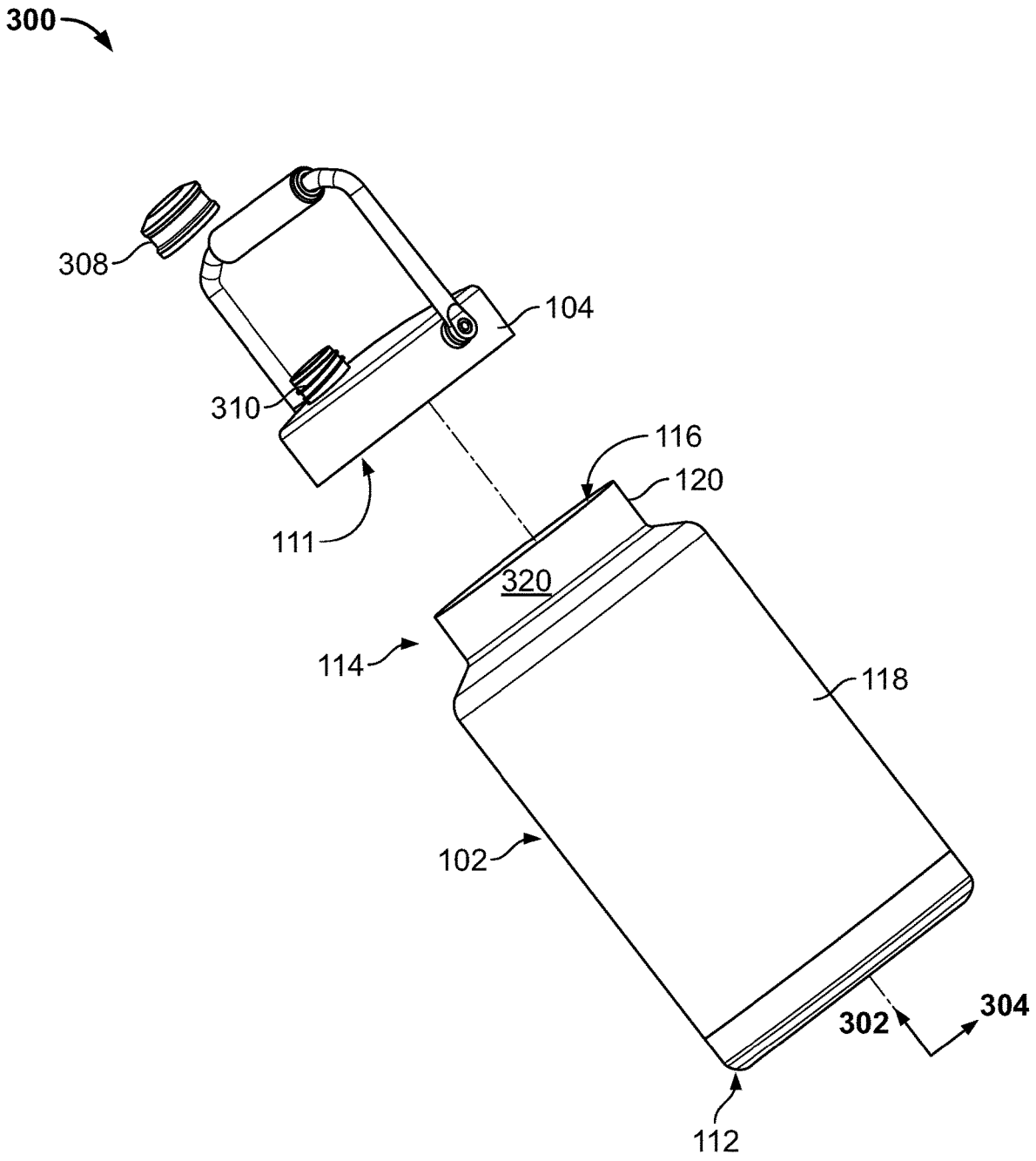
FIG. 3 depicts an exploded isometric view of another example container, according to one or more aspects described herein.

FIG. 1 depicts an isometric view of a container 100. In one example, container 100 may comprise a bottom portion 102 having a lid 104 removably coupled thereto. In one example, the bottom portion 102 may be substantially cylindrical in shape. In various examples, bottom portion 102 may be referred to as a canister 102, or base 102. The bottom portion 102 may, alternatively, be referred to as an insulated base structure having a substantially cylindrical shape, and having an opening 116 in one end 114 as shown in FIG. 3. In another example to that implementation depicted FIG. 1, the bottom portion 102 may be substantially cuboidal, or prismoidal (e.g. a pentagonal prism, hexagonal prism, heptagonal prism, among others) in shape. In one implementation, the lid 104 may comprise a carry handle structure 106.

Figure 2:
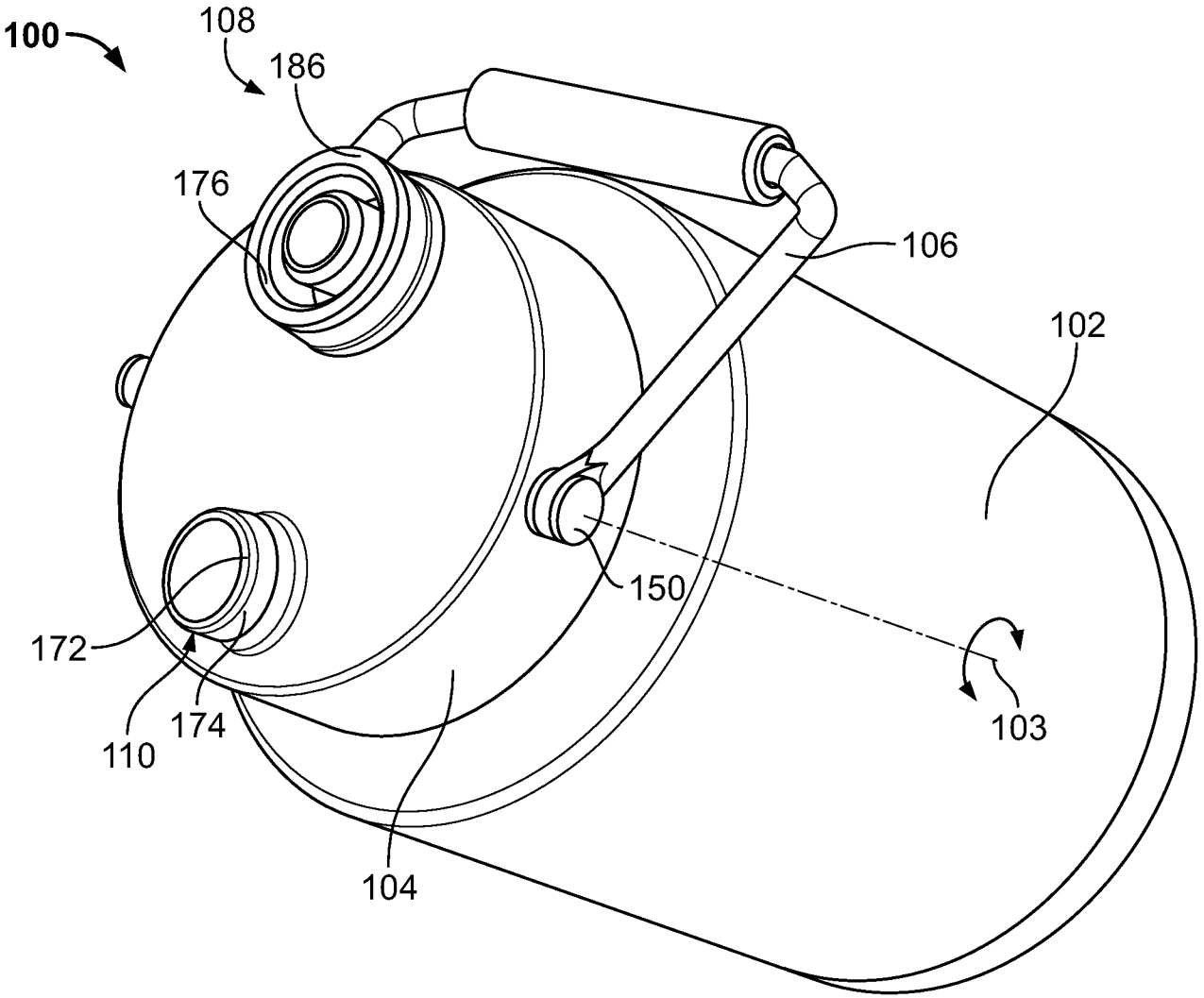
FIG. 2 depicts another isometric view of the container of FIG. 1, according to one or more aspects described herein.

In various examples, the lid 104 may comprise a cap 108 (in one example, cap 108 may be substantially cylindrical), configured to removably couple to, and seal (i.e. resealably seal), a spout opening 110, as depicted in FIG. 2. In one implementation, the carry handle structure 106 may be rotatably coupled to the lid 104, such that the carry handle structure 106 may be pivoted from a first position, as depicted in FIG. 1, to a plurality of second positions, wherein one second position, from the plurality of second positions, is depicted in FIG. 2. For example, the carry handle structure 106 may be rotatable about an axis 103 through a fastener 150 that couples the carry handle structure 106 to the lid 104 (see FIG. 2). In one implementation, the carry handle structure 106 may be rotatable about axis 103 through an angle of greater than 320°. In another example, the carry handle structure 106 may be rotatable about axis 103 through an angle of greater than 300°, greater than 280°, greater than 260°, greater than 240°, or greater than 220°, among others.

In one example, the canister 102 may be configured to store a volume of liquid. In one implementation, the canister 102 may be configured to store approximately 1 gallon (approximately 3.79 L) of a liquid. In another implementation, the canister 102 may be configured to store at least approximately 30 ounces (approximately 0.89 L), at least approximately 50 ounces (approximately 1.48 L), at least approximately 70 ounces (approximately 2.07 L), at least approximately 80 ounces (approximately 2.37 L), at least approximately 90 ounces (approximately 2.66 L), at least approximately 100 ounces (approximately 2.96 L), at least approximately 110 ounces (approximately 3.25 L), or at least approximately 120 ounces (approximately 3.55 L) of a liquid, among others.

Figure 5:
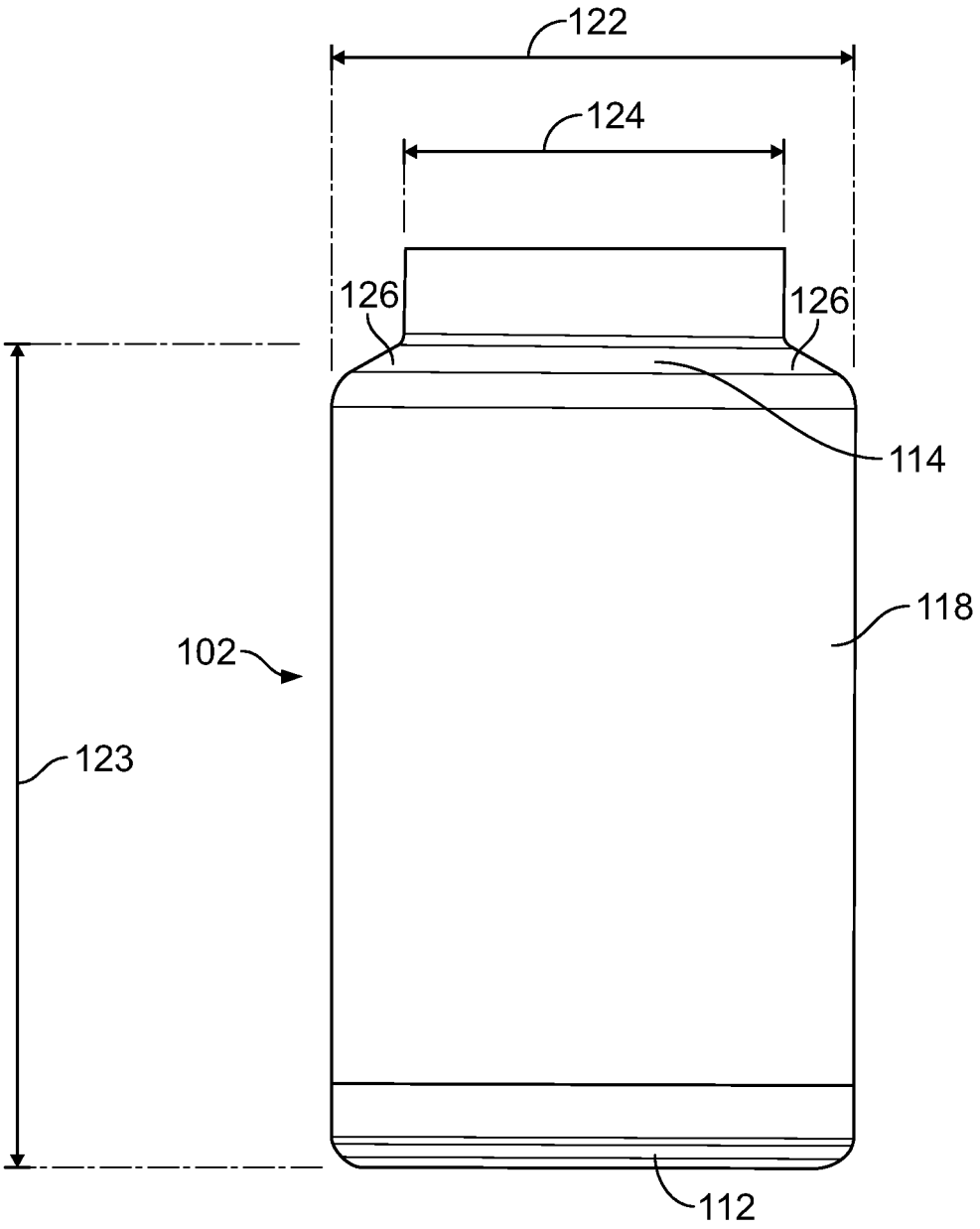
FIG. 5 depicts a side view of a canister, according to one or more aspects described herein.

Turning briefly to FIG. 5, the canister 102 may have an outer diameter 122, and a height 123. In one implementation, the outer diameter 122 may measure approximately 6.5 inches (165.1 mm). In another implementation, the outer diameter 122 may measure approximately 5.7 inches (145 mm). In yet another implementation, the outer diameter 122 may range between 5 inches and 8 inches. In one example, the height 123 may measure approximately 9.7 inches (246.4 mm). In another implementation, the height 123 may measure approximately 7.4 inches (188 mm). In yet another implementation, the height 123 may range between 7 and 11 inches. However, in other implementations, the canister 102 may be embodied with different dimensional values for the outer diameter 122 and the height 123, without departing from the scope of this disclosure. Additionally, the canister 102 may maintain a same aspect ratio between the outer diameter 122 and the height 123 as that depicted in, for example, FIG. 5. However, in another implementation, the canister 102 may be embodied with dimensions such that a different aspect ratio between the outer diameter 122 and the height 123 to that depicted FIG. 5 may be utilized. In yet another implementation, canister 102 may be configured with any external or internal dimensions, and such that the canister 102 may be configured to store any volume of liquid, without departing from the scope of the disclosure described herein. Additionally or alternatively, the container 100 may be configured to store materials in a liquid, a solid, or a gaseous state, or combinations thereof, without departing from the scope of the disclosure described herein.

Turning again to FIG. 1, in various examples, the canister 102 may comprise a first end 112 forming a base configured to support the canister 102 on an external surface. In one example, for the implementation of container 100 having a substantially cylindrical bottom portion 102 (canister 102), the first end 112 may have a substantially circular shape. The canister 102 may comprise a second end 114 having an opening 116 therein, as depicted in FIG. 3. Further, the first end 112 and the second end 114 may be separated by a curved sidewall 118 forming a substantially cylindrical shape of the canister 102. In one implementation, the opening 116 may be configured to allow a liquid to be introduced into, or removed from the canister 102. In another example, when the lid 104 is coupled to the canister 102, the opening 116 may be configured to allow a liquid stored in the canister 102 to flow into the lid 104 and out through the spout 110.

In one example, the spout opening 110 may be configured with an annular ridge 172. As such, the cap 108 may be configured to be removably-coupled to the spout 110 using an interference fit between the annular ridge 172 on a cylindrical outer wall 174 of the spout opening 110, and a corresponding ridge (not pictured in FIG. 1 or FIG. 2) on an inner surface 176 of the cap 108, as depicted in FIG. 2.

FIG. 3 depicts an exploded isometric view of another example container 300, according to one or more alternative aspects described herein. In one implementation, container 300 may be similar to container 100 from FIG. 1 and FIG. 2, where similar reference numerals represent similar features. In one example, container 300 may also comprise a lid 104 having a spout opening 310. However, the spout opening 310 may include a threaded outer wall 168 for receiving a correspondingly threaded inner wall of the cap 308. Specifically, as shown in FIGS. 3 and 4, the depicted cap 308 may be similar to the cap 108, but instead of utilizing an interference fit, the cap 308 may comprise a threaded inner wall 170 configured to be screwed onto a threaded cylindrical outer wall 168 of the spout opening 310.

In one example, the lid 104 may have a substantially cylindrical shape. In one implementation, the lid 104 may be configured to removably couple to a neck structure 120 of the canister 102. As such, the neck structure 120 may encircle the opening 116 in the canister 102, and extend out from the canister 102 in a substantially axial direction. In one implementation, an axial direction 302 associated with canister 102 may be parallel to an axis of rotation of a substantially cylindrical structure of canister 102, as depicted in FIG. 3. In one implementation, a radial direction 304 may be perpendicular to the axial direction 302. In various examples, lid 104 may have an opening 111 configured to receive the neck structure 120. Further details of a removable coupling between the lid 104 and the neck structure 120 are discussed in relation to FIG. 4.

In various examples, the canister 102 may be embodied with different geometries. For example, container 100 or container 300 may be embodied with a base portion, similar to canister 102, having a non-cylindrical shape. In particular, container 100 or container 300 may have a base, similar to canister 102, having a substantially cuboidal, spherical, or prismoidal shape, or combinations thereof, among others, without departing from the scope of the disclosures described herein. As such, container 100 or container 300 may have a base portion, similar to canister 102, having a non-cylindrical shape, but maintaining a substantially cylindrical neck structure 120, configured to be removably coupled to a substantially cylindrical lid 104. In yet another implementation, an opening, similar to opening 116, and a neck structure, similar to neck structure 120, may have non-circular geometries, without departing from the scope of the disclosures described herein. Additionally or alternatively, a lid of container 100 or container 300, similar to lid 104, may have a non-circular shape, without departing from the scope of the disclosures described herein. For example, a lid of container 100 or container 300, similar to lid 104, may have a substantially cuboidal, spherical, or prismoidal shape, or combinations thereof, among others, without departing from the scope of the disclosures described herein.

Figure 4:
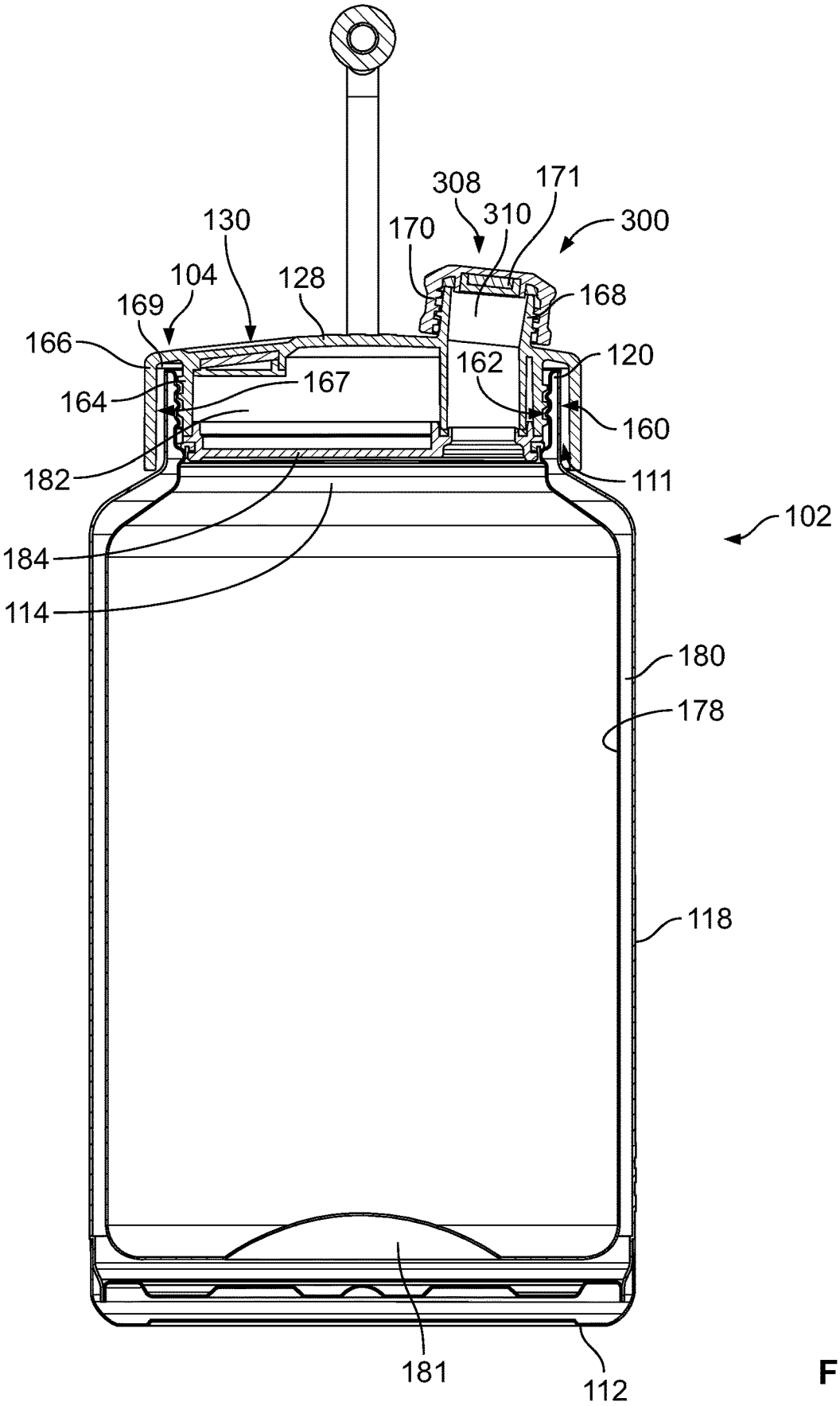
FIG. 4 depicts a cross-sectional sectional view of the container of FIG. 3, according to one or more aspects described herein.

FIG. 4 depicts a cross-sectional view of one implementation of the container 300. In one example, the lid 104 may be removably coupled to the canister 102 using a threaded fastening mechanism. Accordingly, in one implementation, the neck structure 120 may have a smooth outer surface 160 and a threaded inner surface 162. In this way, the threaded inner surface 162 may be configured to interface with a threaded inner wall 164 of the lid 104. As such, when coupled to the canister 102, an outer wall 166 of the lid 104 may cover the neck structure 120.

Additional or alternative coupling mechanisms may be utilized to removably couple the lid 104 to the canister 102, without departing from the scope of the disclosures described herein. For example, the neck structure 120 may be embodied with a threaded outer surface (e.g. outer surface 320 may be threaded) and configured to interface with a corresponding threaded structure on the lid 104. In one example, this additional or alternative threaded structure on the lid 104 may be on an inside surface of the outer wall 166 (e.g. threads may be formed on inside surface 167 of the outer wall 166), among others.

In one example, a connection mechanism configured to removably couple the lid 104 to the canister 102 may be designed such that the coupling is fully engaged upon rotation of the lid 104 relative to the canister 102 by any number of revolutions, or by any fraction of a revolution. For example, the lid 104 may be fully engaged with the canister 102 upon placing the lid 104 on the neck structure 120, and rotating the lid 104 by approximately ¼ of one full revolution, approximately ⅓ of one full revolution, approximately ½ of one full revolution, approximately 1 full revolution, approximately 2 full revolutions, approximately 3 full revolutions, at least 1 revolution, or at least five revolutions, among many others.

In one implementation, a removable coupling between the lid 104 and the canister 102 may comprise one or more gaskets (e.g. gasket 169) configured to seal the coupling such that, in one example, liquid may not escape from the canister 102 while the removable coupling between the lid 104 and the canister 102 is engaged.

In one example the cap 308 may be fully engaged with the threaded fastening mechanism of the spout 310 by rotating the cap 308 relative to the spout 310 through an angle. For example, the cap 308 may be fully engaged with the spout 310 by rotating the cap 308 by approximately ¼ of one full revolution, approximately ⅓ of one full revolution, approximately ½ of one full revolution, approximately 1 full revolution, approximately 2 full revolutions, approximately 3 full revolutions, at least one revolution, or at least five revolutions, among many others.

In one implementation cap 108 (or cap 308) may seal the spout opening 110 (or spout opening 310) using one or more deformable gaskets structures that are compressed when the cap 108 (or cap 308) is brought into a removable coupling with the spout opening 110 (or spout opening 310). In one example, element 171 may be a gasket between the spout opening 310 and the cap 308.

In one implementation, containers 100 and 300 may include one or more insulating elements configured to reduce a rate of heat transfer to or from a material stored within the container. In one example, the canister 102 may be configured with a vacuum-sealed insulating structure, otherwise referred to as a vacuum-sealed double wall structure, or an insulated double wall structure, and such that a vacuum is maintained between an inner wall 178 and an outer wall 118 of the canister 102. In one implementation, a sealed vacuum cavity 180 may be sandwiched between the inner wall 178 and the outer wall 118. In other examples, specific implementations of insulating structures that utilize one or more vacuum chambers to reduce heat transfer by conduction, convection and/or radiation may be utilized within canister 102, without departing from the disclosures described herein. In another implementation, containers 100 and 300 may include an insulated double wall comprising an inner wall 178 and an outer wall 118. In one example, a cavity 180 between the inner wall 178 and the outer wall 118 may be filled with air to form an air pocket. In another example, the cavity 180 may be filled with an insulating material, such as an insulating foam (e.g. polystyrene).

In one example, the combination of the inner wall 178 and the outer wall 118 may be referred to as an insulated wall. In one implementation, the first end 112, the second end 114, the curved sidewall 118, and/or a shoulder region 126 (described in further detail in relation to FIG. 5) may comprise a vacuum-sealed insulated wall between the inner wall 178 and the outer wall 118. Further, an inner surface of one or more of the inner wall 178 or the outer wall 118 may comprise a silvered surface configured to reduce heat transfer by radiation.

In one implementation, canister 102 may comprise a concave structure 181 formed in the first end 112. In one example, the concave structure 181 may provide added rigidity to the first end 112, and such that the concave structure 181 reduces, or prevents, deformation of the first end 112 as a result of a vacuum within the vacuum cavity 180. Accordingly, the concave structure 181 may have any radius or multiple radii of curvature (i.e. the concave structure 181 may comprise a geometry having multiple radii of curvature), without departing from the scope of these disclosures.

In another implementation, the cavity 180 may be filled with an insulating material that exhibits low thermal conductivity. As such, the cavity 180 may, in one example, be filled with a polymer material, or a polymer foam material. In one specific example, the cavity 180 may be filled with polystyrene. However, additional or alternative insulating materials may be utilized to fill the cavity 180, without departing from the scope of these disclosures. In one example, a thickness of the cavity 180 may be embodied with any dimensional value, without departing from the scope of these disclosures In one example, the canister 102 may be constructed from one or more metals, alloys, polymers, ceramics, or fiber-reinforced materials. Additionally, canister 102 may be constructed using one or more hot or cold working processes (e.g. stamping, casting, molding, drilling, grinding, forging, among others). In one implementation, the canister 102 may be constructed using a stainless steel. In one specific example, the canister 102 may be formed substantially of 304 stainless steel. In one implementation, one or more cold working processes utilized to form the geometry of the canister 102 may result in the canister 102 being magnetic (may be attracted to a magnet).

In one example, and as depicted in FIG. 4, the lid 104 may be embodied with a cavity 182. As such, this cavity 182 may be formed between the top surface 128 and a bottom surface 184. In this way, the cavity 182 may provide further insulation to the container 300 by containing one or more of an air pocket, a vacuum-sealed cavity, or by containing a mass of an insulating material, among others. In one specific example, the cavity 182 may be filled with a polymer foam, such as polystyrene. However, additional or alternative insulating materials may be utilized to fill the cavity 182, without departing from the scope of these disclosures.

FIG. 5 depicts an end view of canister 102, which may be used with container 100 or container 300. Accordingly, canister 102 may have a first outer diameter 122 at the first end 112 and a second outer diameter 124 at the opening 116 of the canister 102. In one example, the second diameter 124 may be less than the first diameter 122, such that an outer diameter of the substantially cylindrical sidewall 118 tapers from the first outer diameter 122 to the second outer diameter 124 along a shoulder region 126. In one example, the shoulder region 126 may improve heat transfer performance of the canister 102 (reduce a rate of heat transfer) when compared to a container having a constant outer diameter between a first end, similar to first end 112, and a second end, similar to the second and 114. In particular, the first end 112, the curved sidewall 118 (otherwise referred to as the outer wall 118), and the shoulder region 126 may comprise insulation having lower thermal conductivity (higher thermal resistance/insulation) than the lid 104 that seals the opening 116. As such, a configuration of container 100 or container 300 having opening 116 with a smaller second diameter 124 than the first diameter 122 provides for an increased surface area having the comparatively higher performance insulation (lower thermal conductivity insulation).

In another implementation, having the second outer diameter 124 less than the first outer diameter 122 may increase the structural rigidity of the canister 102 at the second end 114, and such that the opening 116 may be less prone to undesirable warping/bending during one or more processes used to form the structure of the canister 102.

In another example, the container 100 should not be limited to having a first diameter 122 greater than a second diameter 124 such that an outer diameter of the substantially cylindrical sidewall 118 tapers from said first outer diameter 122 to said second outer diameter 124 along a shoulder region 126. As such, the canister 102 may have a substantially constant outer diameter (not pictured), and such that an opening, similar to opening 116, may have a diameter approximately equal to an outer diameter of a first end of the base, similar to the first end 112.

Figure 6:
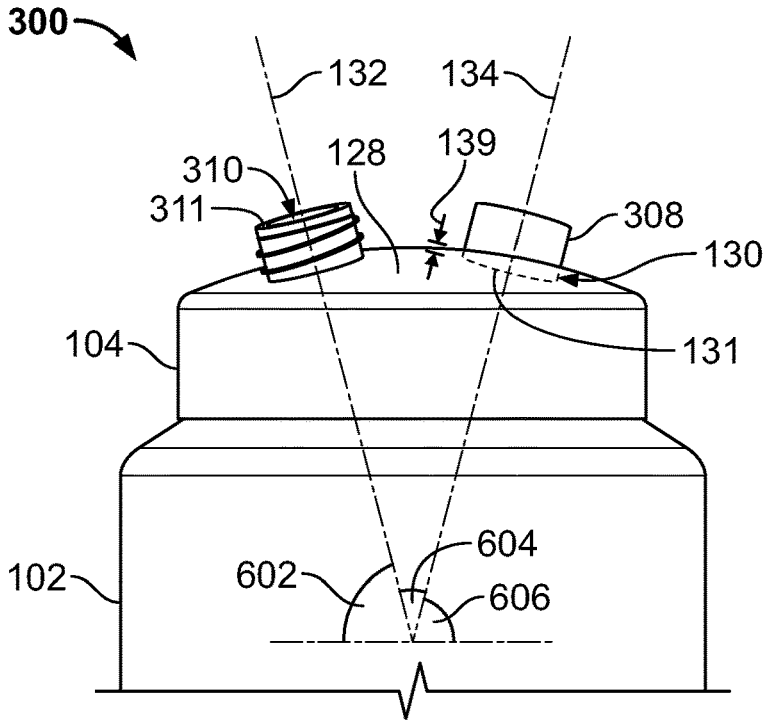
FIG. 6 schematically depicts an end view of the container of FIG. 3, according to one or more aspects described herein.

FIG. 6 schematically depicts an end view of container 300. In one implementation, the lid 104 may be configured with a circular domed (convex) top surface 128. In one implementation, the cap 308, when removed from the spout opening 310, may be positioned within a dimple 130, otherwise referred to as a recess structure 130 (depicted in the plan view of container 300 of FIG. 7). In one implementation, when positioned within the dimple 130, the cap 308 may be angled away from the spout 310, as schematically depicted in FIG. 6.

Additionally, FIG. 6 depicts the cap 308 removed from the spout 310 and positioned within the dimple 130. The spout 310 may have a central axis 132 corresponding to (parallel to) an axis of rotation associated with a substantially cylindrical structure of the spout opening 310. The central axis 132 may be perpendicular to an annular ridge 311 of the spout opening 310, similar to annular ridge 172 of the spout opening 110 from FIG. 2. In various examples, the dimple 130 may have a central axis 134 corresponding to (parallel to) an axis of rotation associated with a substantially circular structure of the dimple 130. The central axis 134 may be perpendicular to a planar surface 131 of the dimple 130.

In various examples, the spout 310 extends from the substantially convex geometry of the circular domed top surface 128 and has a central axis 132 which extends along a normal 132 relative to the domed top surface 128. The dimple 130 also includes a central axis 134 (which may be parallel to a central axis of cap 308, when positioned within dimple 130) and extends substantially along a normal 134 relative to the domed top surface 128, such that the spout 310 and the cap 308 may angled away from one another. Advantageously, and in various examples, this relative positioning of the spout 310 and the cap 308 may allow for improved separation, such that the cap 308 is not contacted when a user is drinking from/pouring from the spout 310.

In one implementation, an angle between central axis 132 (otherwise referred to as normal 132) and central axis 134 (otherwise referred to as normal 134) is schematically depicted as angle 604. As such, angle 604 may be referred to as an intersection angle 604 between a central axis 132 of the spout 310 and a central axis 134 of the dimple 130. As such, angle 604 may be greater than approximately: 2°, 5°, 10°, 15°, 20°, 30°, 45°, 55°, 60°, 70°, 80°, 90°, 100°, or 110°, among others. In another implementation, angle 604 may range from 2 to 110 degrees, among others. Angle 602 schematically represents an angle between central axis 132 (normal 132) and a base surface of the container 300 (e.g. first end 112). In one example, angle 602 may be referred to as a tilt angle 602 between the central access 132 and a base surface of the container 300 (e.g. first end 112, or any plane parallel thereto). In this way, tilt angle 602 may be an angle of less than 90°. As such, in various examples angle 602 may be less than approximately: 90°, 85°, 80°, 70°, 45°, or 30°, among others. In another implementation, angle 602 may range from 30 to 90 degrees, among others. Similar to angle 602, angle 606 schematically represents an angle between central axis 134 (normal 134) and a base surface of the container 300 (e.g. first end 112, or any plane parallel thereto). As such, angle 606 may be referred to as tilt angle 606. In this way, tilt angle 606 may be an angle of less than 90°. In various examples, angle 606 may be less than approximately: 90°, 85°, 80°, 70°, 60°, 45°, or 30°, among others. In one implementation, angle 606 may range from 30 to 90 degrees, among others. In one example, angle 602 may be approximately equal to angle 606. However, in other examples, angle 602 may not be equal to 606.

In one implementation, the circular domed top surface 128 may have a radius of curvature equal to approximately 13.5 inches (342 mm). However, in other implementations, any radius of curvature may be utilized to form the convex geometry of the circular domed top surface 128, without departing from the scope of these disclosures. Additionally or alternatively, the circular domed top surface 128 may comprise multiple radii of curvature, without departing from the scope of this disclosure.

In another implementation, the lid 104 may be configured with other top surface geometries than that circular domed top surface 128 depicted in FIG. 6. For example, lid 104 may have a substantially planar, or a substantially concave top surface, among others (not pictured). Furthermore, one or more of axes 132 and 134 may, in other implementations, not be normal to the circular domed top surface 128. In yet another implementation, axes 132 and 134 may be parallel to one another.

Figure 7:
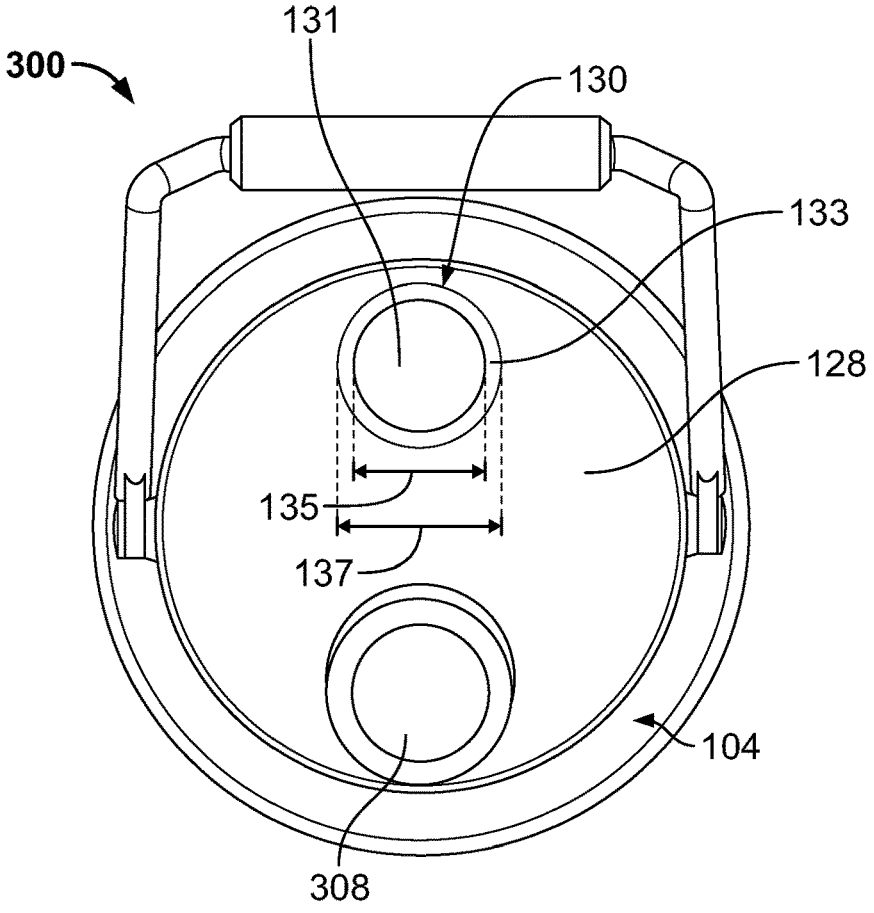
FIG. 7 schematically depicts a plan view of the container of FIG. 3, according to one or more aspects described herein.

FIG. 7 schematically depicts a plan view of the container 300. In one implementation, the dimple 130 may have a substantially circular geometry. In particular, the dimple 130 may have a concave geometry. Accordingly, a concave geometry of dimple 130 may be embodied with any radius of curvature, without departing from the scope of these disclosures. In another example, the dimple 130 may have a flat bottom (i.e. substantially planar) surface 131 connected to the circular domed top surface 128 by a sidewall 133. In one example, the sidewall 133 may be straight, chamfered, or filleted. As such, in one implementation, the dimple 130 may have an inner diameter 135, an outer diameter 137, and a depth 139 (see FIG. 6). For that implementation of dimple 130 having a straight sidewall 133 between surface 131 and surface 128, the inner diameter 135 may be approximately equal to the outer diameter 137.

In one specific example, the inner diameter 135 may measure approximately 25.5 mm, and the outer diameter 137 may measure approximately 29.4 mm. In another example, the inner diameter 135 may measure up to approximately 28 mm, and the outer diameter 137 may measure up to approximately 30 mm. In other examples, the inner diameter 135 and the outer diameter 137 may be embodied with any dimensions, without departing from the scope of these disclosures. In one implementation, the depth 139 of the dimple 130 may range from 1 mm or less to 5 mm or more. However, the depth 139 may be embodied with any value, without departing from the scope of this disclosure. Further, the sidewall 133, if chamfered, may be angled at any angular value between the surface 131 and the surface 128. Similarly, the sidewall 133, if filleted, may have any radius of curvature between the surface 131 and the surface 128.

In one implementation, the magnetic surface 131 may comprise a polymer outer layer over a ferromagnetic structure (i.e. a metal plate may be positioned below magnetic surface 131 in order for the magnetic surface 131 to attract a magnet embedded within a magnetic top surface 136 of the cap 308 (see FIG. 8). In another implementation, the magnetic surface 131 may comprise a polymer overmolded over a magnet structure (i.e. a magnet may be positioned within the lid 104 as it is being molded.

The term "magnetic," as utilized herein, may refer to a material (e.g. a ferromagnetic material) that may be magnetized. As such, the term "magnetic" may imply that a material (i.e. a surface, or object, and the like) may be magnetically attracted to a magnet (i.e. a temporary or permanent magnet) that has an associated magnetic field. In one example, a magnetic material may be magnetized (i.e. may form a permanent magnet). Additionally, various examples of magnetic materials may be utilized with the disclosures described herein, including nickel, iron, and cobalt, and alloys thereof, among others.

Figure 8:
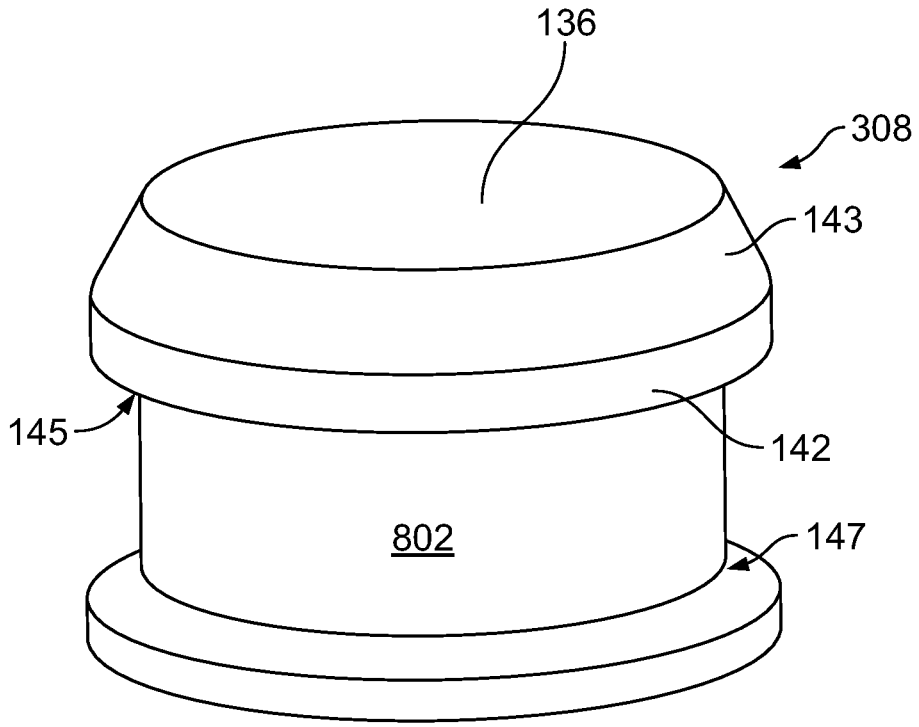
FIG. 8 depicts an example cap structure, according to one or more aspects described herein.

FIG. 8 depicts a more detailed view of the cap 308. In particular, cap 308 may be configured with a substantially cylindrical geometry. In one implementation, the cap 308 may comprise a magnetic top surface 136. As such, the cap 308 may be configured to removably couple to, and seal, the spout 310. Further, upon manual removal of the cap 308 from the spout 310, the magnetic top surface 136 may be configured to magnetically couple to a magnetic surface 131 of the dimple 130, as depicted in FIG. 7. As such, the dimple 130 may comprise a magnetic material to which the magnetic top surface 136 may be magnetically attracted.

In one example, the cap 308 may be constructed from a polymer material, and formed using one or more injection molding processes. As such, the magnetic top surface 136 may comprise an overmolded permanent magnet. Various permanent magnet materials may be utilized with the magnetic top surface 136 of cap 308, without departing from the scope of the disclosures described herein. In one particular example, the magnetic top surface 136 may comprise a neodymium magnet of grade N30, among others. Furthermore, various overmolding methodologies may be utilized to encapsulate a magnet within the cap 308, without departing from the scope of the disclosures described herein. In another example, the cap 308 may comprises a permanent magnet coupled below the polymeric magnetic top surface 136 such that the permanent magnet may be ultra-sonically welded, or glued onto a surface within the cap 308 (e.g. magnet 173 may be retained within the cap 308 by structure 175, which may comprise a polymer plate that is ultrasonically welded, glued, or otherwise coupled to the cap 308.

Advantageously, a magnetic coupling between the magnetic top surface 136 of cap 308, and the magnetic surface 131 of dimple 130 may provide for fast, temporary storage of cap 308 while a liquid is being poured from container 300. In this way, a user may quickly affix cap 308 into dimple 130 such that cap 308 may not be set aside on an external surface where it may be misplaced or contaminated. Further advantageously, a magnetic coupling between the magnetic top surface 136 of the cap 308 and a magnetic surface 131 of the dimple 130 may encourage surfaces 136 and 131 to contact one another such that a bottom surface of cap 308 (e.g. bottom surface 186 of cap 108, which may be similar to 308) does not contact the magnetic surface 131 of the dimple 130. In this way one or more surfaces, including the bottom surface 186, of cap 108 or 308 may be exposed to fewer contaminants, and thereby reduce transmission of fewer contaminants to spout 310 upon re-coupling of the cap 308 with the spout 310. It is noted that the previously described advantages with regard to magnetically coupling the cap 308 into the dimple 130 may, additionally or alternatively, be realized with cap 108 from container 100.

In one example, cap 308 may comprise one or more polymer materials. However, cap 308 may comprise one or more of a metal, an alloy, a ceramic, or a wood material or combinations thereof, without departing from the scope of the disclosure described herein.

In one example, cap 308 may have a substantially cylindrical shape with a cylindrical outer wall 802. As such, cap 308 may be embodied with any outer diameter for the outer wall 802, without departing from the scope of this disclosure. In one example, cap 308 may have a surface 143 extending between the magnetic top surface 136 and a side surface 142. In one implementation, the surface 143 may form a chamfer between the top surface 136 and the side surface 142. As such, surface 143 may be embodied with any chamfer angle between the top surface 136 and the side surface 142. In another implementation, surface 143 may form a fillet between the top surface 136 on the side surface 142. As such, an example filleted surface 143 may be embodied with any desired fillet angle or radius. In one implementation, surface 143 may be utilized to center the cap 308 within the dimple 130. In one implementation, a fillet radius of surface 143 may be approximately equal to a fillet radius of surface (sidewall) 133 of the dimple 130. Similarly, and in another implementation, a chamfer angle of surface 143 may be approximately equal to a chamfer angle of surface (sidewall) 133 of dimple 130. In one example, the cap 308 may have lip structures 145 and/or 147 to facilitate manual gripping of the cap 308 to remove upon removal of the cap 308 from the spout 310 or the dimple 130, among others. In another implementation, the cap 308 may be implemented such that outer wall 802 has an outer diameter equal to the outer diameter of surface 142, and such that the cap 308 is not embodied with lip structures 145 and/or 147.

Figure 11:
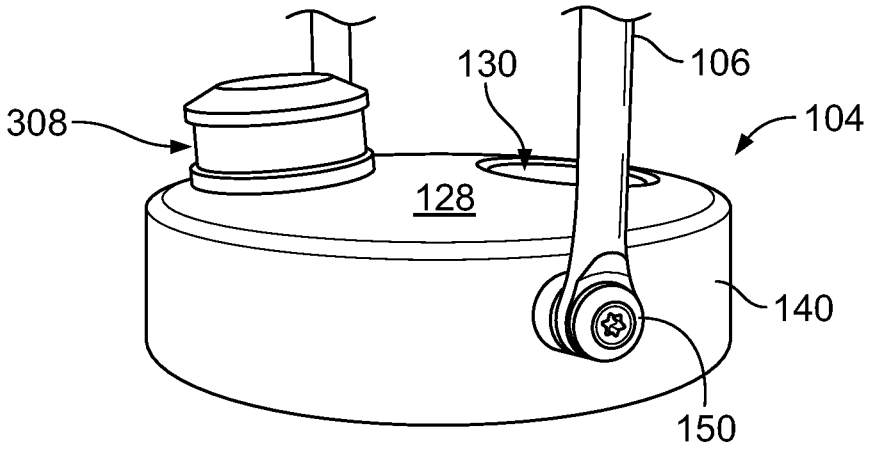
FIG. 11 schematically depicts an isometric view of another example lid structure, according to one or more aspects described herein.

In one example, and as depicted in FIG. 11, the spout 310 (FIG. 11 depicts the cap 308 coupled to the spout 310) may be off-center on the circular domed top surface 128. In particular, the spout 310 may be positioned substantially at a perimeter of the circular domed top surface 128. Further, in one implementation, the recess 130 may be diametrically opposed to the spout opening 310, as depicted FIG. 7. However, the spout opening 310 may be positioned in other locations on the lid 104, without departing from the scope of the disclosure described herein. For example, the spout opening 310 may be positioned substantially at a center of the circular domed top surface 128. In another example, the spout opening 110 may be positioned on a curved sidewall of the lid 104, such as the curved sidewall 140 depicted in FIG. 11. In another example, the recess 130 may not be diametrically opposed to the spout opening 310. As such, in one example, the recess 130 may be positioned substantially at a center of the domed top surface 128, while the spout opening 310 may be positioned substantially at the perimeter of the circular domed top surface 128.

In one implementation, the lid 104, as depicted in FIG. 7, may be constructed from a polymeric material. In one example, the lid 104 may be injection molded. In one implementation, dimple 130 may comprise a ferromagnetic structure, or plate, that is overmolded to form the lid 104. In this way, upon manual removal of the cap 308 from the spout 310, the magnetic top surface 136 of the cap 308 may be magnetically attracted to the dimple structure 130 when positioned within a given proximity of the dimple structure 130. In another example, dimple 130 may comprise a ferromagnetic structure, or plate, that is positioned behind the surface 131 (e.g. glued, or ultra-sonically welded or otherwise attached to an interior side of the lid 104 within the cavity 182).

In one example a force needed to remove the cap 308 from the dimple structure 130 (i.e. a force to overcome a magnetic attraction between the cap 308 and the dimple structure 130) may measure approximately 10 N. In another example, the force to remove cap 308 from the dimple structure 130 may range between approximately 7 and 15 N. In another implementation, magnetic top surface 136 may be magnetically coupled to the curved sidewall 118 of the canister 102. Accordingly, in one example, a force needed to overcome a magnetic attraction between the cap 308 and the curved sidewall 118 may measure approximately 3 N. In another example, the force to remove the cap 308 from the curved sidewall 118 may range between approximately 1 and 10 N.

In another implementation, there may be a specific distance/proximity within which magnetic attraction is exerted between the magnetic top surface 136 of the cap 308, and the ferromagnetic structure of the dimple 130. This proximity may be dependent upon a strength (magnetic field strength, and the like) of the magnet contained within the magnetic top surface 136, among other factors. As such, there may exist a proximity within which the magnetic top surface 136 of the cap 308 may be positioned relative to the dimple structure 130 in order to magnetically couple the two structures may be embodied with any distance value. This proximity may be embodied with any value, without departing from the scope of the disclosures described herein. Accordingly, any strength of magnet may be utilized with the disclosures described herein. Additionally, various ferromagnetic materials may be utilized within the dimple structure 130, without departing from the disclosures described herein.

In another example, a ferromagnetic material may be positioned within the dimple structure 130, and such that an overmolding process is not utilized to cover the ferromagnetic material. Similarly, a magnet may be positioned on the magnetic top surface 136 of the cap 308, and such that the magnet is exposed, rather than being overmolded or covered.

In various examples, the container 300 may be configured such that the magnetic top surface 136 of the cap 308 is configured to magnetically couple only within the recess 130. As such, the remainder of container 300 may be constructed using one or more non-magnetic materials. In another example, a magnetic top surface 136 of the cap 308 may be configured to magnetically couple to one of a plurality of locations on the lid 104. In particular, in one example, the circular domed top surface 128 of the lid 104 may comprise a plurality of overmolded ferromagnetic pieces configured to magnetically couple to the magnetic top surface 136 of the cap 308. In another example, the lid 104 may be constructed using, or coated with, a metallic material that may be attracted to a magnetic field.

In various examples, container 300 may be configured such that the magnetic top surface 136 of the cap 308 may be configured to magnetically couple to the spout 310 (i.e. spout 310 may be embodied with one or more ferromagnetic materials). Accordingly, the opening into the canister 102 through the spout opening 310 may be sealed by magnetic attraction of the cap 308 to the spout opening 310.

In various examples, cap 308 may be attached within dimple 130 using another coupling mechanism in addition to, or as an alternative to, the magnetic metric coupling between the magnetic top surface 136 and surface 131. For example, the top surface 136 and surface 131 may be embodied with complementary threaded coupling elements, interference fit coupling elements (i.e. snap coupling), or hook and loop coupling elements, among others.

Additionally or alternatively, the canister 102 may comprise a magnetic material, such that the magnetic top surface 136 may be magnetically coupled to a surface (e.g. the curved sidewall 118) of the canister 102. In one particular example, the canister 102 may comprise a stainless steel material (e.g. 304 stainless steel), and may be magnetized by a one or more cold working processes used to form the various geometries of the canister 102. However, the canister 102, and indeed any of the structures of container 300 described herein, may be constructed using one or more of a metal, an alloy, a polymer, a ceramic, a wood material, or combinations thereof.

In various examples, the recess 130 may comprise an overmolded, or otherwise covered, permanent magnet, and the magnetic top surface 136 of the cap 308 may comprise an overmolded ferromagnetic material (e.g. iron). In yet another example, both of the magnetic top surface 136 and the recess structure 130 may comprise overmolded, or otherwise covered, permanent magnets configured to attract one another, and the like.

Figure 9:
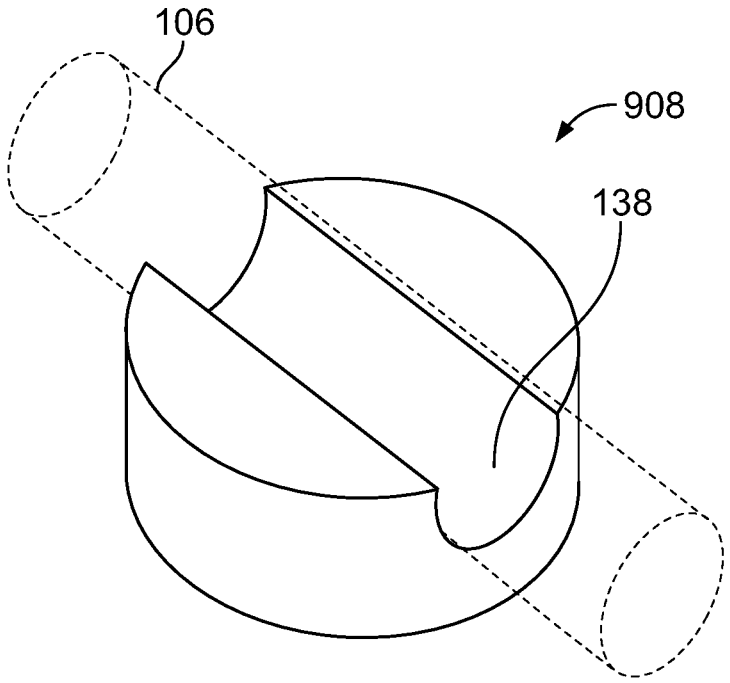
FIG. 9 depicts another example cap structure, according to one or more aspects described herein.

In one example, the cap 308 may comprise a substantially planar magnetic top surface 136. In this way, the substantially planar magnetic top surface 136 may be configured to interface with a substantially planar surface of the recess 130. In another example, a cap 308 may be configured with different geometries. For example, the cap 308 may comprise a curved top surface 136. In another example, FIG. 9 depicts a cap 908 having a magnetic channel structure 138 (rounded surface 138) configured to allow the cap 908 to be magnetically coupled to a curved surface. In one implementation, the magnetic channel structure 138 may be configured to magnetically couple to one or more curved surfaces of the carry handle structure 106. In this way, the carry handle structure 106 may be configured with one or more magnetic materials (overmolded, covered, or exposed magnetic materials). In one implementation, one or more portions of the carry handle structure 106 may comprise a magnet and such that one or more portions of the carry handle structure 106 may be magnetically attracted to, and held in position when brought into contact with, sidewall 118. In yet another example, the magnetic channel structure 138 may have a concave geometry configured to conform to a curved surface geometry of a curved sidewall 118 of the canister 102. As such, the magnetic channel structure 138 may comprise one or more overmolded, or otherwise covered, permanent magnet structures, similar to the magnetic top surface 136 of cap 308 depicted in FIG. 8.

Figure 10:
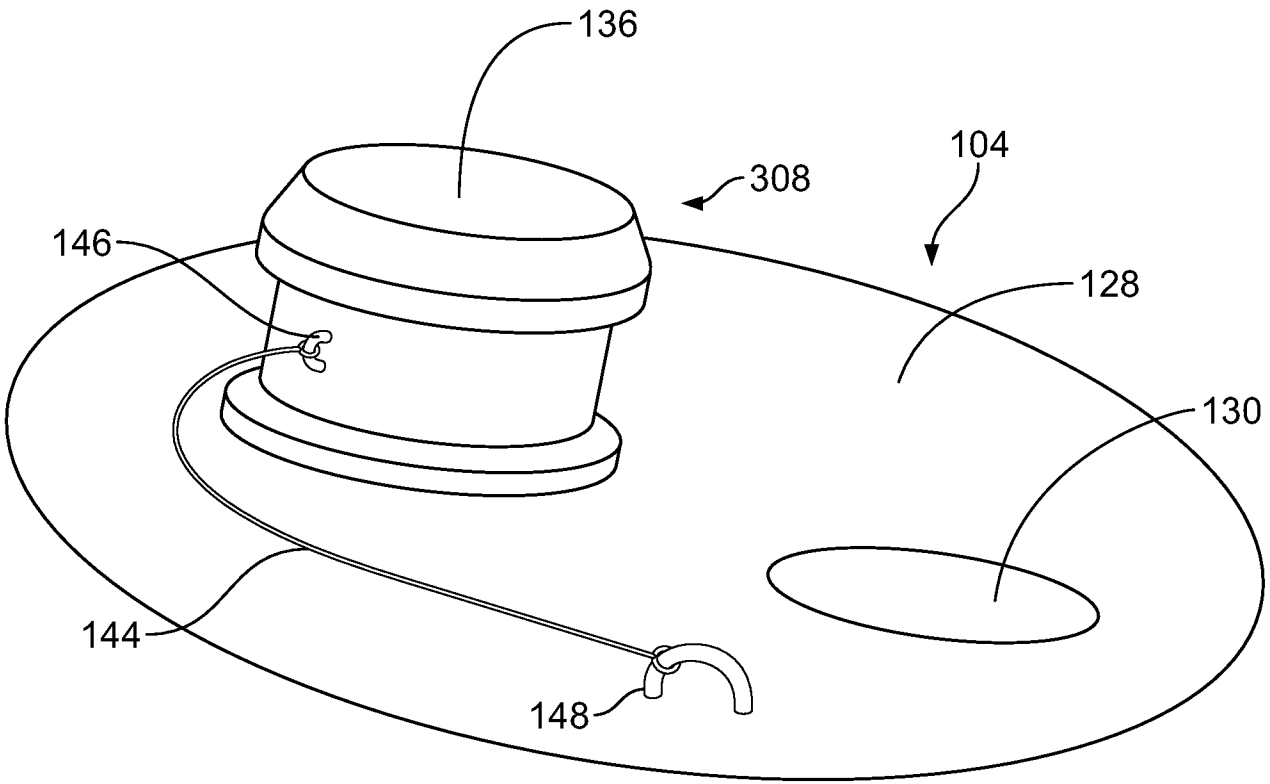
FIG. 10 schematically depicts an isometric view of an example lid structure, according to one or more aspects described herein.

In one implementation, the cap 308 may be embodied with additional or alternative features. For example, and as depicted in FIG. 10, the cap 308 may be embodied with a tether 144 connected between a first anchor point 146 on the cap 308 and a second anchor point 148 on the lid 104. The first anchor point 146 and the second anchor point 148 can be in the form of U-shaped connectors that are either separately fastened or integrally molded. Advantageously, the tether 144 may be utilized to prevent separation of the cap 108 and the lid 104, and may be utilized in combination with a magnetic coupling between a magnetic top surface 136 and a recess 130, such that the magnetic coupling prevents the cap 108 from falling into a stream of liquid being poured from the spout 310, among others. As such, the tether 144 may comprise any flexible material, such as a polymer, a metal, or an alloy, among others, and may be embodied with any length. Similarly, the first anchor point 146 and the second anchor point 148 may be positioned at different locations on the cap 308 and the lid 104, respectively, without departing from the scope of the disclosures described herein.

FIG. 11 depicts a more detailed view of a hinged coupling between the carry handle structure 106 and the lid 104. In particular, a rotatable coupling between the carry handle structure 106 and the lid 104 may be facilitated by fastener 150. In one implementation, fastener 150 may act as a bearing about which the carry handle structure 106 may rotate relative to the lid 104. In one implementation, fastener 150 may comprise a screw configured to be received into a recess in the curved sidewall 140 of the lid 104. However, additional or alternative fastening mechanisms that may be utilized to hingedly couple the carry handle structure 106 to the lid 104, without departing from the scope of the disclosures described herein.

Figure 12:
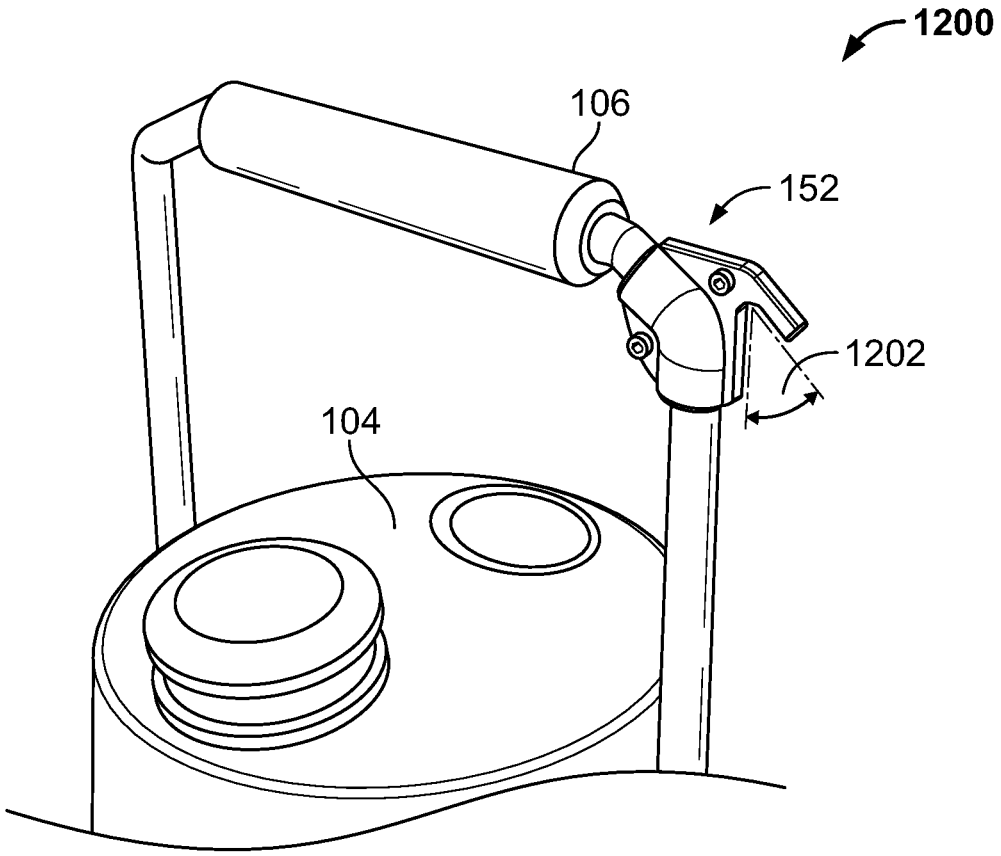
FIG. 12 depicts an isometric view of another example container structure, according to one or more aspects described herein.

FIG. 12 depicts an implementation of a container 1200. Accordingly, container 1200 may be similar to containers 100 and 300, and may, additionally, be embodied with a hook structure 152 rigidly coupled to the carry handle structure 106. As such, the hook structure 152 may be configured to allow the container to be hung from an external structure (e.g. a chain-link fence, similar to fence 156 from FIG. 13, among many others). As depicted in FIG. 12, the hook structure 152 may be positioned at one side of the carry handle structure 106. However, alternative configurations for the hook structure 152 may be utilized without departing from the scope of the disclosures described herein. For example, container 1200 may be embodied with two or more hook structures (e.g. one hook structure to either side of the carry handle structure 106).

In one implementation, the hook structure 152 may be angled at an angle 1202. In one specific example, angle 1202 may range be range from approximately 20° to approximately 75°. However, additional or alternative implementations of the hook structure 152 may be utilized, including an angle 1202 outside of the range of 20° to 75°, without departing from the scope of these disclosures.

Figure 13:
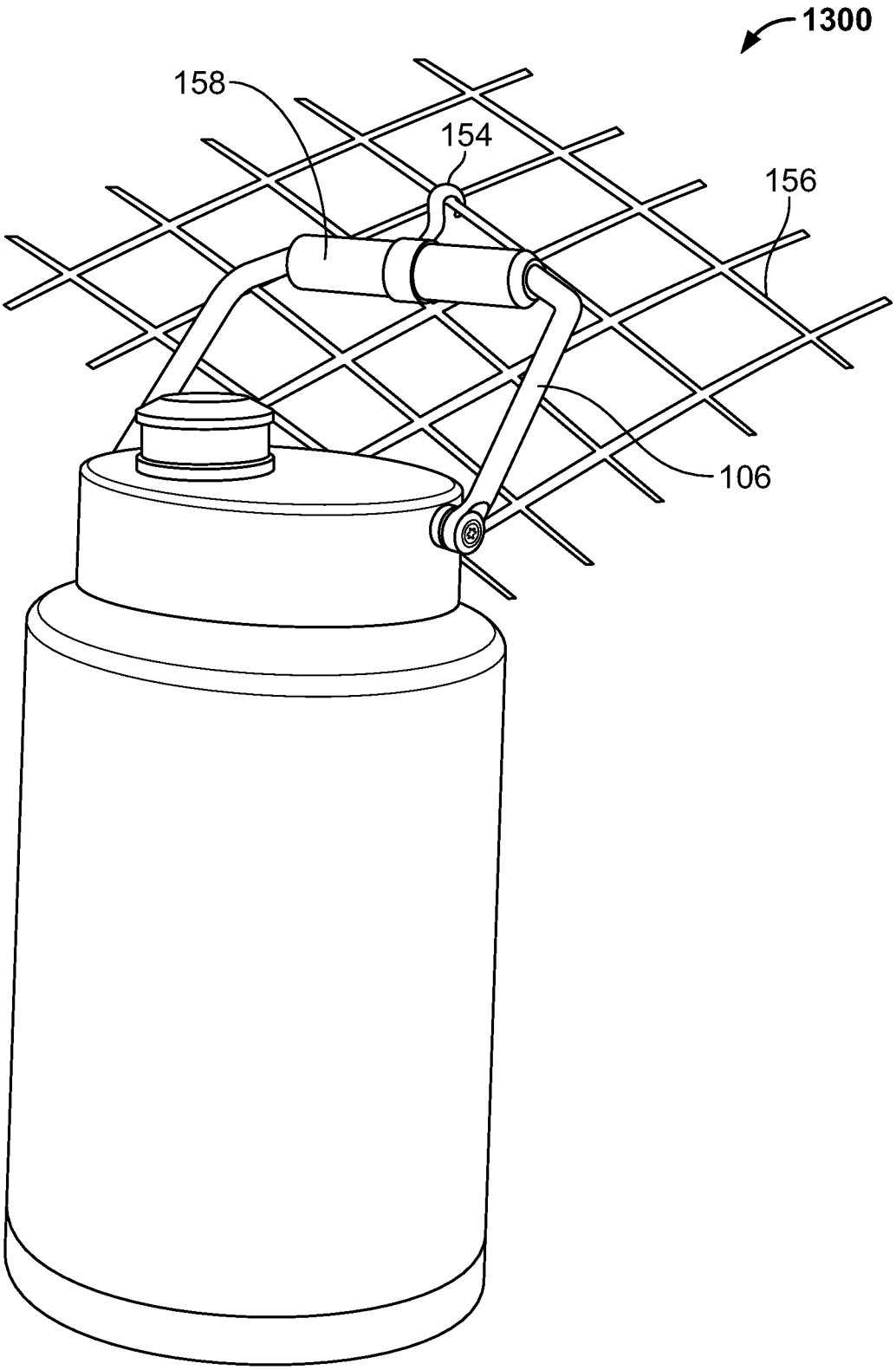
FIG. 13 depicts an isometric view of another example container structure, according to one or more aspects described herein.

FIG. 13 depicts another example implementation of a container 1300. Accordingly, container 1300 may be similar to containers 100, 300, and 1200 where similar reference numerals represent similar components and features. In this example implementation, container 1300 may have a hook structure 154, which may be positioned as a center of a grip structure 158 of the carry handle structure 106, and such that the container 100 may be hung from a chain-link fence 156, among others. Accordingly, hook structure 152 and hook structure 154 may be constructed from one or more metals, alloys, or polymers, without parting from the scope of the disclosures described herein.

According to one aspect, an insulating container may have a canister that has an insulated double wall with a first end to support the canister on a surface, a second end, and a sidewall. The canister may also have an opening in the second end that extends through the insulated double wall. A neck structure may encircle the opening and extend in an axial direction. A lid may seal the opening by receiving the neck structure into a corresponding opening in the lid. The lid may further have a circular domed top surface having a spout opening, and a removable cap that seals the spout opening. Further, the cap may have a magnetic top surface configured to be magnetically attracted to, and retained within, a dimple on the domed top surface.

According to another aspect, a container may have a bottom portion with a first end, a second end having an opening, and a cylindrical wall spaced between the first and the second end. The bottom portion may taper from a first outer diameter at the first end, to a second, smaller outer diameter at the second end. The bottom portion may further have a neck structure around the opening. Additionally, the container may have a lid that seals the opening, the lid further having an opening to receive the neck structure. A top surface of the lid may have a spout opening, and a removable cylindrical cap that seals the spout opening. The removable cylindrical cap may have a magnetic top surface. Additionally, the top surface may have a recess with a magnetic surface that magnetically couples to the magnetic top surface of the cylindrical cap when removed from the spout.

In yet another aspect, a container may have an insulated base structure with a cylindrical shape and an opening in one end. The container may also have a lid with a bottom surface that seals the insulated base structure. A top surface of the lid may have a spout, and a cap that removably couples to, and seals, the spout. The cap may have a magnetic top surface. Additionally, the lid may have at least one ferromagnetic piece, and a carry handle. Further, a tilt angle between a central axis of the spout and the bottom surface of the lid may be less than 90°.

Figure 14:
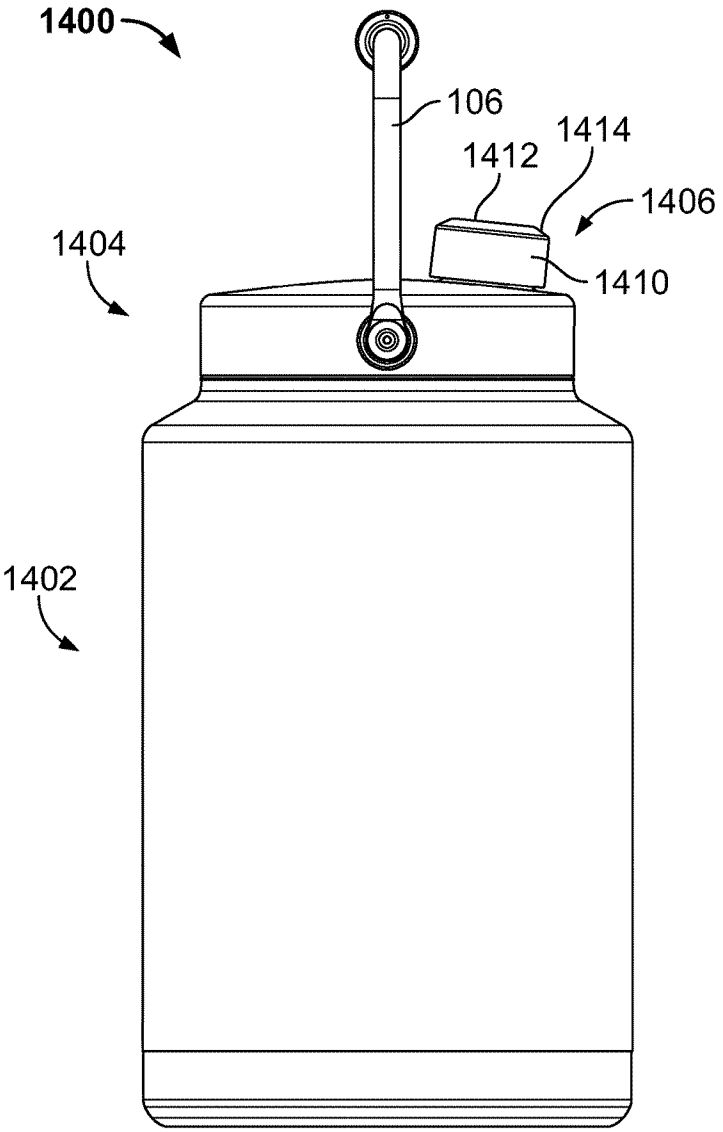
FIG. 14 depicts another implementation of a container structure, according to one or more aspects described herein.

FIG. 14 depicts another implementation of a container 1400, according to one or more aspects described herein. In one example, container 1400 may comprise a bottom portion 1402 having a lid 1404 removably-coupled thereto. Further, the bottom portion 1402 may be referred to as a canister, base, or insulated base structure that has a substantially cylindrical shape, among others. Carry handle 106 may be rotatably-coupled to the lid 1404. Additionally, the lid 1404 may comprise a cap 1406 that is configured to removably-coupled to, and resealably seal a spout opening 1408 (as depicted in FIG. 15) of the lid 1404.

In various examples, the cap 1406 may have a substantially cylindrical side wall 1410 separated from a substantially circular magnetic top surface 1412 by a chamfered surface 1414, as depicted in FIG. 14. Accordingly, the chamfered surface 1414 may be similar to surface 143, as depicted FIG. 8. As such, the chamfered surface 1414 may be configured to center the magnetic top surface 1412 of the cap 1406 within the dimple/depression 1416 (as depicted in FIG. 15). In this way, the dimple 1416 may have complementary geometry configured to receive the magnetic top surface 1412 and chamfered surface 1414 of cap 1406.

Figure 15:
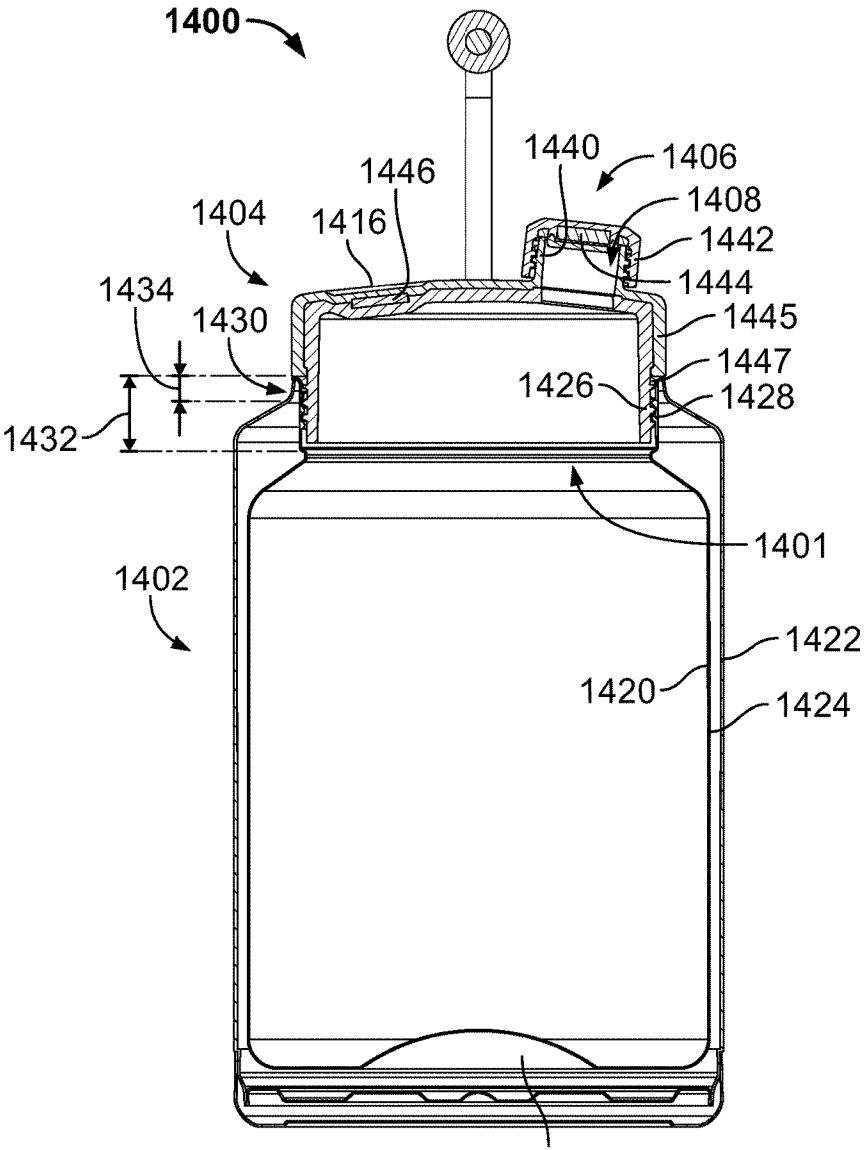
FIG. 15 depicts a cross-sectional view of the container of FIG. 14, according to one or more aspects described herein.

FIG. 15 depicts a cross-sectional view of container 1400. Accordingly, the bottom portion 1402 may comprise a concave structure 1418, similar to concave structure 181 of bottom portion 102. Further, the bottom portion 1402 may have an insulated double wall structure comprising an inner wall 1420 and an outer wall 1422. As such, a sealed vacuum cavity 1424, similar to vacuum cavity 180, may be positioned between the inner wall 1420 and the outer wall 1422. In other implementations, the cavity 1424 may be filled with one or more insulating materials.

In one implementation, the lid 1404 is configured to resealably seal an opening 1401 in the bottom portion 1402. Accordingly, a threaded wall 1426 of the lid 1404 may be received by a threaded sidewall 1428 of the bottom portion 1402 to removably-couple the lid 1404 to the bottom portion 1402.

In various implementations, the bottom portion 1402 may have a neck structure 1430, and such that the threaded sidewall 1426 extends into the bottom portion 1402 to a depth 1432, greater than a height 1434 of the neck structure 1430. As such, the threaded sidewall 1428 may be configured to receive the threaded sidewall 1426 such that the neck structure 1430 abuts/is positioned proximate an outer wall 1445 of the lid 1404 at end 1447.

The spout opening 1408 may be embodied with a threaded sidewall 1440 configured to receive a threaded sidewall 1442 of cap 1406 to removably-couple the cap 1406 to the lid 1404.

A magnetic material 1444, such as, among others, a ferromagnetic plate that is not magnetized, or a permanent magnet, may be positioned below the magnetic top surface 1412 of the cap 1406. In this way, magnetic material 1444 may be similar to magnet 173 from FIG. 4. Similarly, a magnetic material 1446 may be positioned below the dimple 1416. As such, dimple 1416 may be similar to dimple 130.

In addition to the various elements described in relation to container 1400 and depicted in FIG. 14 and FIG. 15, container 1400 may comprise one or more additional or alternative elements described in relation to containers 100 or 300, without departing from the scope of these disclosures.

The present disclosure is disclosed above and in the accompanying drawings with reference to a variety of examples. The purpose served by the disclosure, however, is to provide examples of the various features and concepts related to the disclosure, not to limit the scope of the invention. One skilled in the relevant art will recognize that numerous variations and modifications may be made to the examples described above without departing from the scope of the present disclosure.

We claim:

1. An insulating container, comprising:
- a canister comprising:
  - an insulated double wall structure comprising:
    - a first end, configured to support the canister on a surface;
    - a second end; and
    - a sidewall;
  - an opening in the second end extending through the insulated double wall structure; and
  - a neck structure encircling the opening; and
- a lid adapted to seal the opening, the lid comprising:
  - a threaded sidewall configured to be received into the neck structure; and
  - a top surface, further comprising:
    - a spout;
    - a removable cap adapted to resealably seal the spout, and comprising a first surface;
    - a depression structure located on the top surface, the depression structure further comprising a second surface onto which the first surface of the cap is magnetically attracted; and
    - a sealed cavity spaced between the top surface and a bottom surface of the lid, wherein the spout extends through the sealed cavity between the top surface and the bottom surface of the lid.

2. The insulating container of claim 1, wherein the spout and the depression structure are off-centered on the top surface and diametrically opposed to one another.

3. The insulating container of claim 1, wherein the second surface of the depression structure comprises a permanent magnet positioned below the second surface of the depression structure.

4. The insulating container of claim 1, wherein the first surface of the cap comprises a permanent magnet positioned below the first surface of the cap.

5. The insulating container of claim 1, wherein the cap is magnetically attracted to and retained within the depression structure with the first surface in contact with the second surface of the depression structure.

6. The insulating container of claim 1, wherein the cap is configured to seal the spout with an interference fit between an annular ridge on a cylindrical outer wall of the spout and a corresponding ridge on an inner surface of the cap.

7. The insulating container of claim 1, wherein the spout further comprises a threaded cylindrical outer wall configured to interface with a threaded inner surface of the cap.

8. The insulating container of claim 1, wherein a first opening of the lid comprises a threaded inner wall configured to screw onto a threaded inner surface of the neck structure.

9. The insulating container of claim 1, wherein the insulated double wall structure comprises a sealed vacuum cavity between an inner wall and an outer wall.

10. The insulating container of claim 1, further comprising a chamfered sidewall connecting the second surface of the depression structure to the top surface of the lid.

11. The insulating container of claim 1, further comprising a filleted sidewall connecting the second surface of the depression structure to the top surface of the lid.

12. A container, comprising:
- a bottom portion, further comprising:
  - a first end configured to support the container on a surface, wherein the first end has a first outer diameter;
  - a second end having an opening, wherein the opening has a second outer diameter smaller than the first outer diameter;
  - a cylindrical wall spaced between the first end and the second end, wherein an outer diameter of the cylindrical wall tapers from the first outer diameter to the second outer diameter along a shoulder region of the cylindrical wall; and
  - a neck structure encircling the opening; and
- a lid adapted to resealably seal the opening, the lid further comprising:
  - a threaded sidewall configured to be received into the neck structure;
  - a top surface, further comprising:
    - a spout opening; and
    - a cap adapted to resealably seal the spout opening;
  - a sealed cavity spaced between the top surface and a bottom surface of the lid, wherein the spout extends through the sealed cavity between the top surface and the bottom surface of the lid; and a carry handle, rotatably coupled to a cylindrical sidewall of the lid.

13. The container of claim 12, wherein the cap further comprises a first surface and wherein the top surface further comprises a recess having a second surface adapted to receive, and magnetically couple to, the first surface of the cap when the cap is manually removed from the spout opening, the recess further comprising an outer diameter at the top surface and an inner diameter, less than the outer diameter, at a flat-bottomed magnetic surface of the recess.

14. The container of claim 13, wherein a ferromagnetic plate is positioned below the recess.

15. The container of claim 12, wherein the carry handle comprises a ferromagnetic material configured to optionally magnetically couple to the top surface of the cap.

16. The container of claim 13, wherein the first surface comprises a permanent magnet.

17. The container of claim 13, wherein the recess is positioned off-center on the top surface, diametrically opposed to the spout opening.

18. An insulating container, comprising:

a canister comprising:

an insulated double wall structure comprising:

a first end, configured to support the canister on a surface;

a second end; and a sidewall;

an opening in the second end extending through the insulated double wall structure; and a neck structure encircling the opening; and a lid adapted to seal the opening, the lid comprising:

a threaded sidewall configured to be received into the neck structure; and a top surface, further comprising:

a spout on the top surface;

a removable cap adapted to resealably seal the spout, and comprising a magnetic top surface; and a sealed cavity spaced between the top surface and a bottom surface of the lid, wherein the spout extends through the sealed cavity between the top surface and the bottom surface of the lid.

19. The insulating container of claim 1, wherein the second surface of the depression structure comprises a ferromagnetic plate positioned below the second surface of the depression structure.

20. The insulating container of claim 1, wherein the first surface of the cap comprises a ferromagnetic plate positioned below the first surface of the cap.

* * * * *